US010973382B2

(12) United States Patent
Nieschwitz et al.

(10) Patent No.: US 10,973,382 B2
(45) Date of Patent: Apr. 13, 2021

(54) CENTRAL VACUUM SYSTEM AND INLET VALVES THEREFOR

(71) Applicant: H-P Products, Inc., Louisville, OH (US)

(72) Inventors: Darrell V. Nieschwitz, Louisville, OH (US); Greg A. Calderone, Canton, OH (US); Shawn C. Metz, Louisville, OH (US)

(73) Assignee: H-P Products, Inc., Louisville, OH (US)

( * ) Notice: Subject to any disclaimer, the term of this patent is extended or adjusted under 35 U.S.C. 154(b) by 374 days.

(21) Appl. No.: 16/028,916

(22) Filed: Jul. 6, 2018

(65) Prior Publication Data

US 2020/0008638 A1 Jan. 9, 2020

(51) Int. Cl.
*A47L 9/24* (2006.01)
*A47L 5/38* (2006.01)

(52) U.S. Cl.
CPC ..... *A47L 9/242* (2013.01); *A47L 5/38* (2013.01)

(58) Field of Classification Search
None
See application file for complete search history.

(56) References Cited

U.S. PATENT DOCUMENTS

| | | | | | |
|---|---|---|---|---|---|
| 2,102,802 | A * | 12/1937 | Lofgren | A47L 9/242 | 285/7 |
| 2,943,698 | A | 7/1960 | Bishop | | |
| 2,953,806 | A | 9/1960 | Walker | | |
| 3,173,164 | A | 3/1965 | Congdon | | |
| 3,520,725 | A | 7/1970 | Hamrick | | |
| 4,220,360 | A * | 9/1980 | Jacek | F16L 37/096 | 285/317 |
| 4,336,427 | A * | 6/1982 | Lindsay | A47L 5/38 | 137/360 |
| 5,006,799 | A * | 4/1991 | Pfanstiehl | G01B 7/105 | 324/230 |
| 6,459,056 | B1 | 10/2002 | Graham | | |
| 7,624,472 | B2 | 12/2009 | Ambrose | | |
| 2017/0347853 | A1 * | 12/2017 | Dant | A47L 5/36 | |

* cited by examiner

*Primary Examiner* — Brian D Keller
(74) *Attorney, Agent, or Firm* — Sand, Sebolt & Wernow Co., LPA

(57) ABSTRACT

A central vacuum system includes a primary valve box or inlet and a secondary inlet. The central vacuum system includes a hose with a hose plug at the end thereof. The hose is stored in the primary valve box and may be extracted and attached to the secondary inlet. The secondary inlet includes features that enable the hose plug to connect with the secondary inlet. The secondary inlet includes at least one flex member that is configured to connect, in a releasable manner, with a channel formed in the hose plug. The flex member on the secondary inlet includes a section or portion thereof that moves radially relative to a longitudinal axis of the secondary inlet. The portion that moves radially may include a curved profile. This enables the flex member to wrap around a circumferential portion of the hose plug.

13 Claims, 27 Drawing Sheets

9
9
9
200
254
255
212,224
262A
257,259
225
294
256
270
253
280
271
284
274
289
260B
260
260A
258
295
290
286
310
218
202
300
301
302
221
273
303
303B
303C
212,
213
285
299A
A
288
214
249
245
244
242
240
217
215
219
235
237
239
251
303B
303A
299
287
297

CENTRAL VACUUM SYSTEM AND INLET VALVES THEREFOR

BACKGROUND

Technical Field

The present disclosure relates to a central vacuum system. More particularly, the present disclosure relates to inlet valves on a central vacuum system. Specifically, the present disclosure relates to a secondary inlet valve that includes a curved surface to connect with a hose plug on a hose of the central vacuum system.

Background Information

Central vacuum systems for home and commercial use have been used for many years, examples of which are shown in U.S. Pat. Nos. 2,943,698 and 3,173,164. These systems generally are comprised of a main vacuum source which is usually mounted in the basement or other locations in the structure or closely adjacent thereto. The vacuum source is connected to various dedicated inlet valves in the structure by conduits or tubing. These inlet valves, also referred to as valve boxes in the industry, are mounted in a wall, inside of a cabinet or in and on other structures by various types of flanges, brackets, etc. Some examples are shown in U.S. Pat. Nos. 2,953,806, 3,520,725, 4,336,427, 6,459,056, and 7,624,472. Additionally, some central vacuum systems include secondary inlet valves, or which are generally referred to as secondary inlets or auxiliary inlets.

SUMMARY

Issues continue to exist with secondary inlets or auxiliary inlets that are part of a central vacuum system. Namely, there exists a need for an improved manner for attaching a hose to the secondary inlet. The present disclosure addresses this issue and other issues by providing a secondary inlet with a curved section that moves radially relative to a longitudinal axis of the inlet to be, at least partially, circumferentially positioned around a hose plug connected with the hose.

In one aspect, an exemplary embodiment of the present disclosure may provide a secondary inlet valve for a central vacuum system comprising: a port defined by a plate adapted to receive an end of a hose therein along an axis; a concavely curved surface on a moveable member, wherein the concavely curved surface is, at least partially, moveable radially relative to the axis; the moveable member connected to the plate; wherein the concavely curved surface is adapted to move radially away from the axis as the hose passes the first flex member; and the concavely curved surface is adapted to move radially towards the axis to fit within a channel defined adjacent the end of the hose. This embodiment or another exemplary embodiment may further provide a frame connected to the plate; and wherein the moveable member is disposed between the frame and the plate and is lengthwise oriented orthogonal to the axis. This embodiment or another exemplary embodiment may further provide a central curved section defining the concavely curved surface, and the central curved section including a curved chamfer adapted to effectuate the movement of concavely curved surface as a cam on the hose plug passes the curved chamfer. This embodiment or another exemplary embodiment may further provide a cover connected to the plate moveable between a closed first position and an open second position; and wherein the hose plug can only move the concavely curved surface when the cover is moved from the closed first position.

In one aspect, an exemplary embodiment of the present disclosure may provide an inlet valve for a vacuum system, such as a secondary inlet valve, comprising: a port defined by a plate adapted to receive an end of a hose therein along an axis; a first flex member that is, at least partially, flexibly moveable radially relative to the axis; the first flex member connected to the plate; wherein the first flex member is adapted to flex radially away from the axis as the hose passes the first flex member; and the first flex member adapted to flex radially towards the axis to fit within a channel defined adjacent the end of the hose. This embodiment or another exemplary embodiment may further provide a first end of the first flex member connected to the plate; a second end of the first flex member connected to the plate; and a concavely curved section of the body located intermediate the first end and the second end of the first flex member. This embodiment or another exemplary embodiment may further provide wherein the port is 360 degrees in cross section; and an angle of an arc defined by the concavely curved section that is in a range from 15 degrees to 45 degrees relative to the port. This embodiment or another exemplary embodiment may further provide a first flexible bend in the first flex member positioned between the concavely curved section and the first end; and a second flexible bend in the first flex member positioned between the concavely curved section and the second end. This embodiment or another exemplary embodiment may further provide a first annular loop at the first end of the first flex member; and a second annular loop at the second end of the first flex member. This embodiment or another exemplary embodiment may further provide a second flex member that is, at least partially, flexibly moveable radially relative to the axis and located diametrically opposite the first flex member relative to the axis; and a concavely curved section on each of the first and second flex members that respectively engage an annular channel defined adjacent the end of the hose. This embodiment or another exemplary embodiment may further provide wherein the first flex member comprises a linear section that is positioned along a tangent plane of the port. This embodiment or another exemplary embodiment may further provide a cutout section defined by the plate; and a portion of the first flex member extending through the cutout section when the first flex member is flexed radially towards the axis to fit within the channel defined adjacent the end of the hose. This embodiment or another exemplary embodiment may further provide wherein the portion of the first flex member is radially outward from the cutout section when the first flex member is flexed radially away from the axis as the hose passes the first flex member. This embodiment or another exemplary embodiment may further provide a twelve o'clock position of the port; and a portion of the first flex member intersecting the twelve o'clock position of the port. This embodiment or another exemplary embodiment may further provide a pivot action of a first end of the first flex member when the first flex member flexes radially away from the axis. This embodiment or another exemplary embodiment may further provide a frame connected to the plate; and wherein the first flex member is disposed between the frame and the plate. This embodiment or another exemplary embodiment may further provide a central curved section on the first flex member, the central curved section including a curved chamfer adapted to effectuate the flexion of the first flex member as a cam on the hose plug passes the curved chamfer. This embodiment or another exemplary embodiment may further provide a cover connected to the plate moveable between a closed first position and an open second position; and wherein the hose plug can only flex the first flex member when the cover is moved from the closed first position.

In another aspect, an exemplary embodiment of the present disclosure may provide a method comprising: inserting a hose plug coupled with a vacuum hose into a secondary valve of a central vacuum system; moving a section of a first flex member radially relative to an axis of the secondary valve; and connecting, in a releasable manner, the hose plug to the first flex member to position the first flex member in an annular channel defined by the hose plug. This embodiment or another exemplary embodiment may further provide wherein moving the section of the first flex member is accomplished by flexing a bend on the flex member to move a curved section relative to the axis. This embodiment or another exemplary embodiment may further provide positioning a concavely curved section of the first flex member adjacent a cylindrical wall of the hose plug. This embodiment or another exemplary embodiment may further provide extracting the hose plug and an entire hose from a primary valve box prior to inserting the hose plug into the secondary valve. This embodiment or another exemplary embodiment may further provide moving the curved section of the first flex member radially away from the axis to release the connection of the hose plug and the first flex member.

In yet another aspect, an exemplary embodiment of the present disclosure may provide a central vacuum system that includes a primary valve box or inlet and a secondary inlet. The central vacuum system includes a hose with a hose plug at the end thereof. The hose is stored in the primary valve box and may be extracted and attached to the secondary inlet. The secondary inlet includes features that enable the hose plug to connect with the secondary inlet. The secondary inlet includes at least one flex member that is configured to connect, in a releasable manner, with a channel formed in the hose plug. The flex member on the secondary inlet includes a section or portion thereof that moves radially relative to a longitudinal axis of the secondary inlet. The portion that moves radially may include a curved profile. This enables the flex member to wrap around a portion of the hose plug. The partial circumferential alignment of the flex member relative to the hose plug maintains the hose in a desired position during the vacuuming process.

BRIEF DESCRIPTION OF THE SEVERAL VIEWS OF THE DRAWINGS

Various embodiments of the invention are set forth in the following description, are shown in the drawings and are particularly and distinctly pointed out and set forth in the appended claims. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
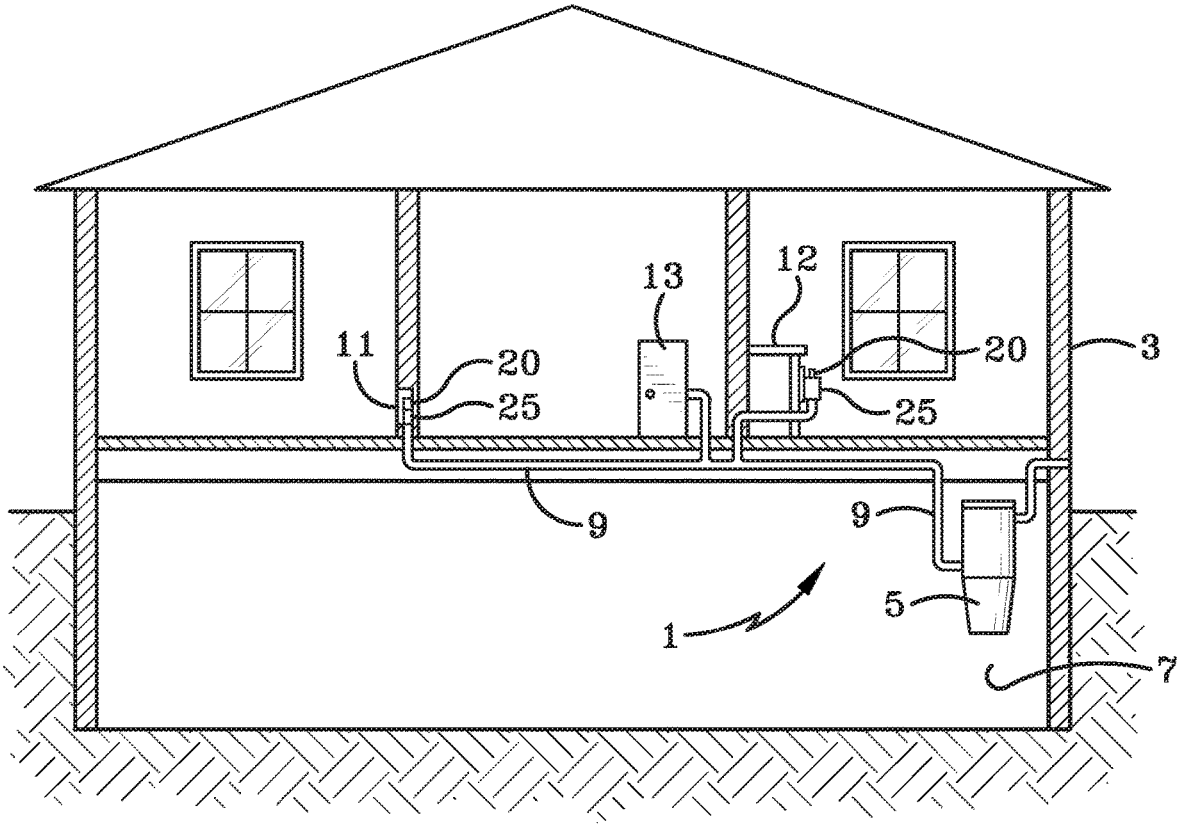
FIG. 1 is a diagrammatic view showing a structure having a central vacuum source in the lower level thereof connected to various inlet valves of the present disclosure located within the structure.

One example of a central vacuum cleaning system in which an inlet valve of the present disclosure is located is indicated generally at 1, and is shown in FIG. 1. A central vacuum source 5 is located within a usual structure 3 such as in a lower level 7. However, vacuum source 5 could be located at other locations in the structure, such as in a garage, or outside closely adjacent thereto. A plurality of vacuum source tubes or conduits 9 extend from vacuum source 5 to various locations or rooms within structure 3. The number of conduits will depend upon the size of the house, number of rooms, size of vacuum source 5, and other factors. These vacuum supply conduits are usually formed of rigid plastic and terminate at various inlet valves in the structure, three of which are shown in FIG. 1.

One of the vacuum supply conduits terminates at a usual air-tight wall main valve 11, whereas another supply conduit terminates at a similar valve in a wall storage cabinet 13, with another supply conduit terminating at a first embodiment of an auxiliary or secondary inlet valve of the present disclosure which is indicated generally at 25 and shown mounted near a counter 12 or other support in the structure 3. It is also readily understood that conduits 9 could extend into various locations within the structure and attach to other types of inlet valves without affecting the concept of the invention.

Figure 2:
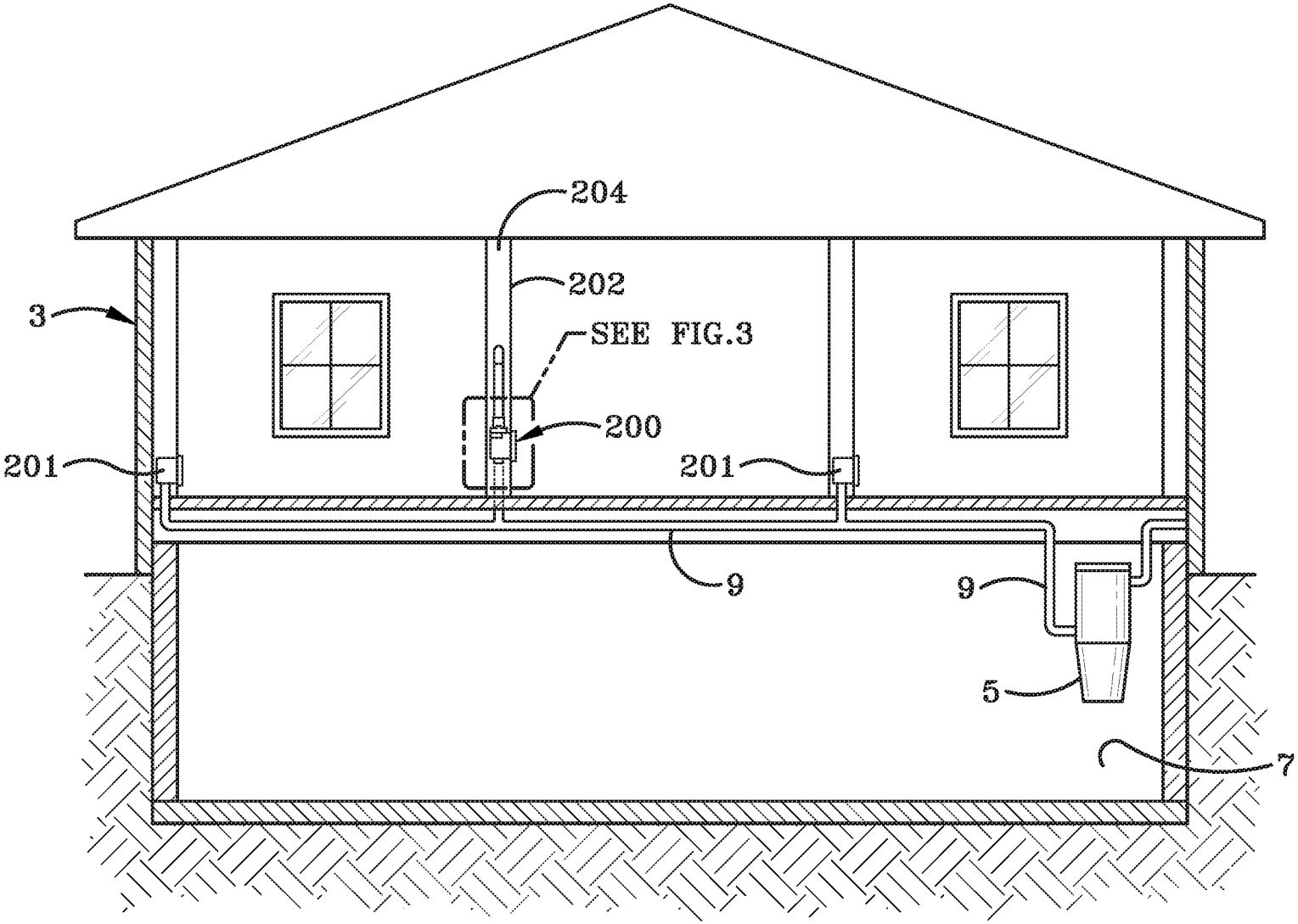
FIG. 2 is a diagrammatic view similar to FIG. 1 showing other types of inlet valve boxes mounted within a structure.
Figure 3:
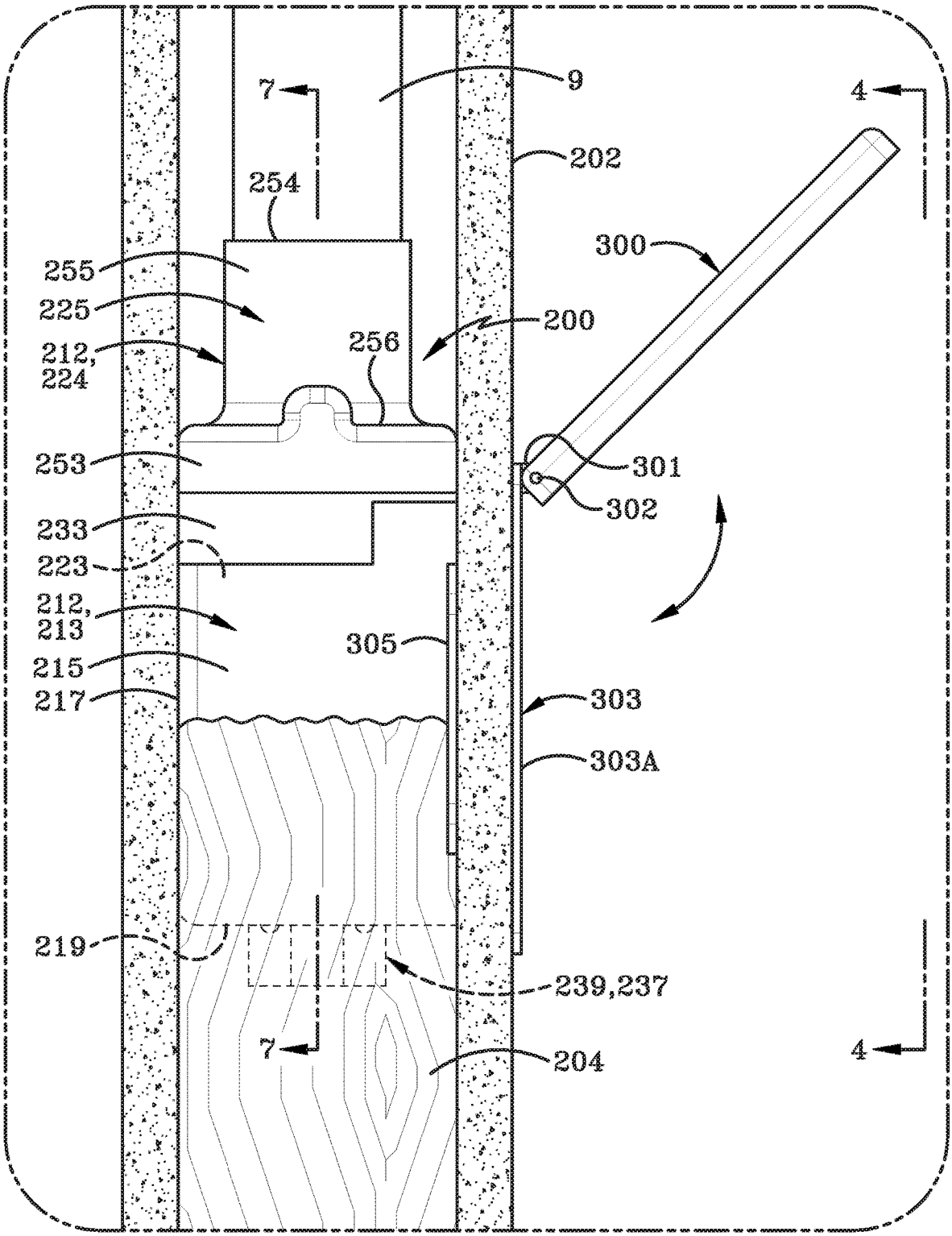
FIG. 3 is an enlarged view of the encircled portion of FIG. 2 with portions broken away showing another type of inlet valve of the present disclosure mounted in a wall opening with the closure door in an open position.

FIG. 2 is another example of a central vacuum cleaning system in which another embodiment of the inlet valve of the present disclosure is incorporated, and which is indicated generally at 200. Inlet valve 200 is shown mounted within structure 3 and connected to central vacuum source 5 by a conduit 9. The vacuum system may contain other types of auxiliary or secondary inlet valves such as indicated at 201, located at other locations in the structure. Again, the number of conduits and inlet valves and types of inlet valves will depend upon the size of the structure, number of rooms, size of the vacuum source 5, and other factors.

Primary inlet valve 200 is shown particularly in FIGS. 2-10 attached to a wall stud 204 and accessible through an opening formed in an attached wall board 202, such as drywall used in a usual home construction. Inlet valve 200 of this modified embodiment is hereafter referred to as a valve box 200 or a primary inlet valve 200. Valve box 200 can be used in various types of constructions and other structure locations than that shown in FIG. 2 and FIG. 3 within the concept of the present disclosure.

Valve box 200 includes a main body or housing indicated generally at 212, formed by a lower portion 213 and an upper portion 224. Lower portion 213 (FIGS. 4A and 5A) is formed by a pair of side walls 215, a rear wall 217, a top wall 218, and a bottom wall 219, which walls define an interior chamber 214, a front or outer end opening 221, and an open top 223. Lower portion 213 preferably will have a rectangular shape as shown in FIG. 21A.

Upper portion 224 (FIGS. 4B and 5C) includes a box top 225 which is mounted on and encloses open top 223 of lower portion 213. The upper edges of side walls 215 of lower portion 213 are formed with U-shaped channels 227 (FIG. 4A) which slidably receive therein complementary-shaped channels 229 formed along side walls 231 of a lower rectangular-shaped bottom portion 233 of box top 225 to mount upper portion 224 on lower portion 213. This sliding engagement enables lower portion 213 and upper portion 224 of housing 212 to be produced independently, preferably of a molded plastic, and then assembled after the various internal components thereof which are described below, are mounted respectively in lower portion 213 and top portion 224.

An enlarged opening 235 (FIG. 6A) is formed in bottom wall 219 of lower portion 213 of housing 212 and receives therein a generally rectangular portion 237 (FIGS. 4A, 5A, and 6A) of a bottom bracket indicated generally at 239, which is secured therein by screws 238. It is readily understood that portion 237 and complementary-shaped opening 235 can have other shapes such as round, oval-shaped, etc. Bracket 239 is formed with a pair of spaced vertically extending channels 241 (FIG. 7) in which are mounted a pair of compression coil springs 243. Springs 243 engage a horizontally extending pin 245 which extends through a diametric hole 247 formed in a ball 249. Ball 249 is located in a central channel 251 formed in bottom bracket 239. A downwardly extending ramp 240 (FIGS. 4 and 6B) is formed by a recessed area in top wall 242 which is formed with an upper flange 244 in which ball 249 is located. The purpose and function of bracket 239 and ball 249 are described further below.

Box top 225 (FIGS. 6B, 7C and 9), in addition to having a lower rectangular portion 233, includes a cylindrical intermediate portion 253 which is connected to an upper reduced diameter cylindrical top portion 255 by a horizontal annular portion 256 providing a bell-shaped configuration to box top 225. Box top 225 is formed with a hollow interior 258 which terminates in a top opening 254. Box top 225 preferably will be a one-piece molded plastic member as are portions 213 and 224 of housing 212. The hollow interiors 214 and 258 of lower portion 213 and box top 225 provide a through bore for inlet valve 200 which terminates in inner open end 254 and outer open end 221 for the passage of a flexible hose 285 therethrough.

Figure 9:
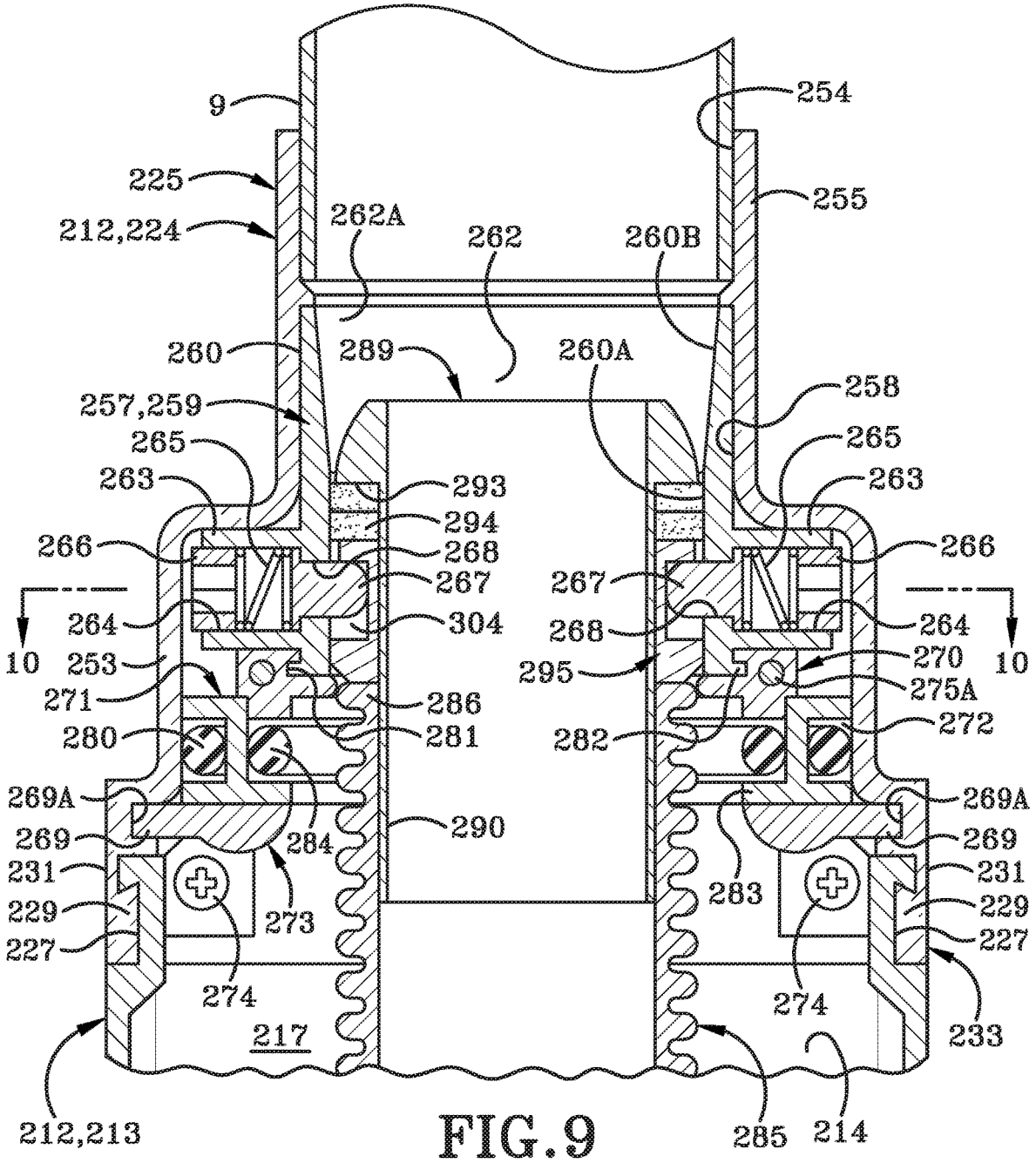
FIG. 9 is an enlarged fragmentary sectional view taken on line 9-9 in FIG. 8 of the distal end of the hose when the hose is in a fully extended position.
Figure 10:
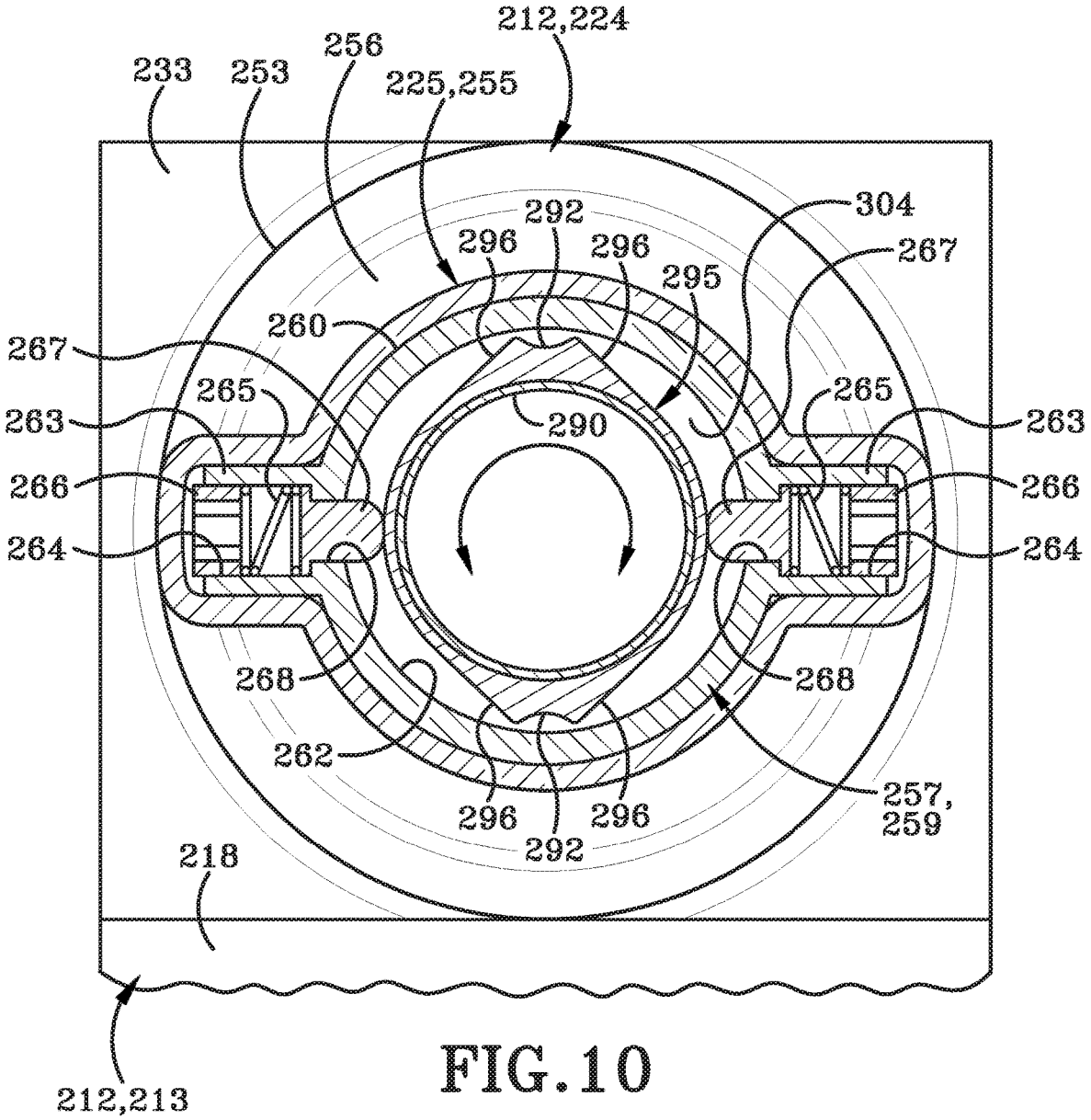
FIG. 10 is a sectional view taken on line 10-10 in FIG. 9.

Within box top 225 is a cylindrical sleeve (FIGS. 6A, 6B, 8 and 9) indicated generally at 257 which provides another seal when the hose reaches its fully extended position as discussed further below. Sleeve 257 has a generally annular configuration formed by an annular wall 259 which has a cylindrical outer surface 260 and a cylindrical lower inner surface 260A which terminates in an outwardly tapered upper inner annular surface 260B which forms a top opening 262A. A pair of diametrically opposed cylindrical lugs 263 extend outwardly from annular wall 259 (FIGS. 9 and 10). Each lug 263 has a hollow bore 264 in which is contained a spring 265 retained therein by an end plug 266. Each spring 265 biases a button 267 outwardly through a hole 268 formed through wall 259 and into the hollow bore 262 of cylindrical sleeve 257. The function of buttons 267 is described further below.

Figure 4:
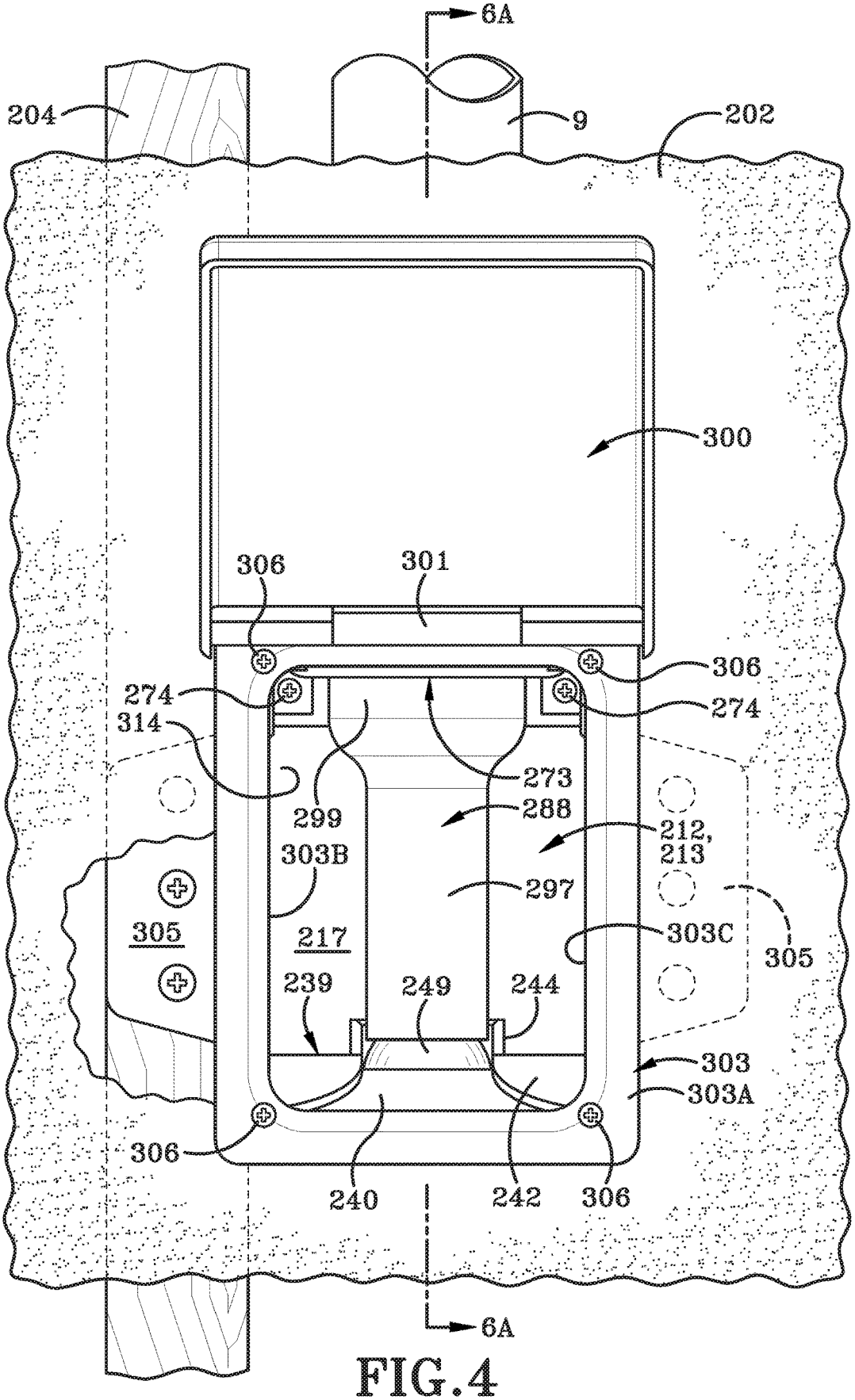
FIG. 4 is a front elevation view looking in the direction of line 4-4 in FIG. 3.
Figure 4A:
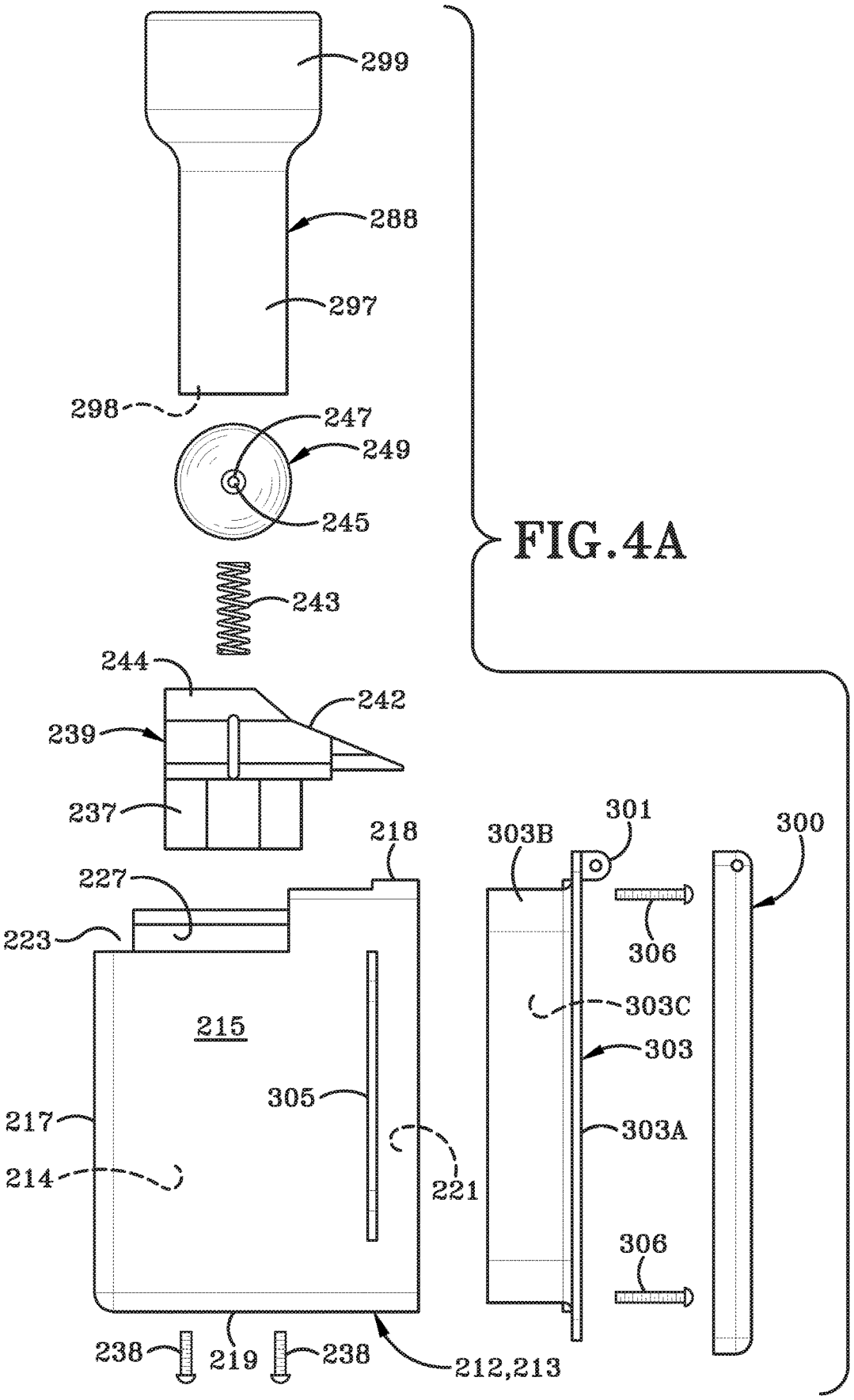
FIG. 4A is an exploded side elevation view showing many of the components in the lower portion of the valve box of FIG. 3 and FIG. 4.
Figure 4B:
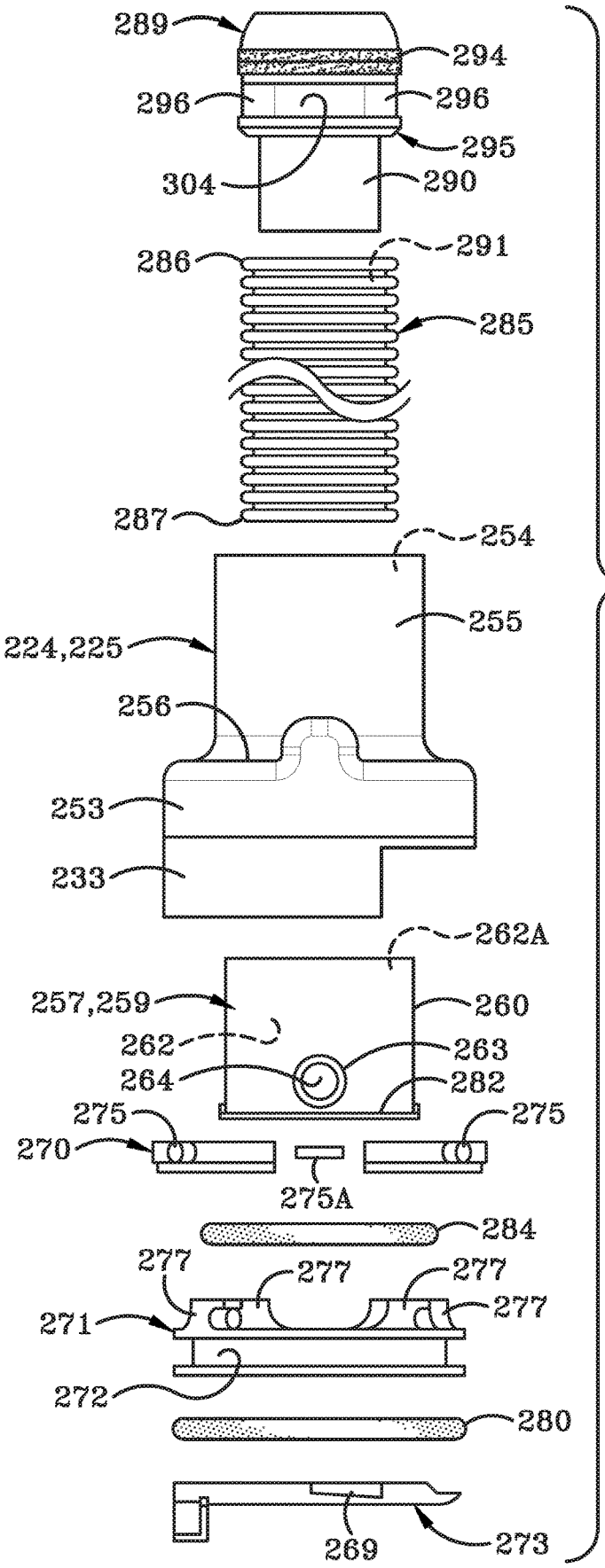
FIG. 4B is an exploded side elevation view of many of the components in the upper portion of the valve box of FIGS. 4-4A and the distal end of the vacuum hose.
Figure 5A:
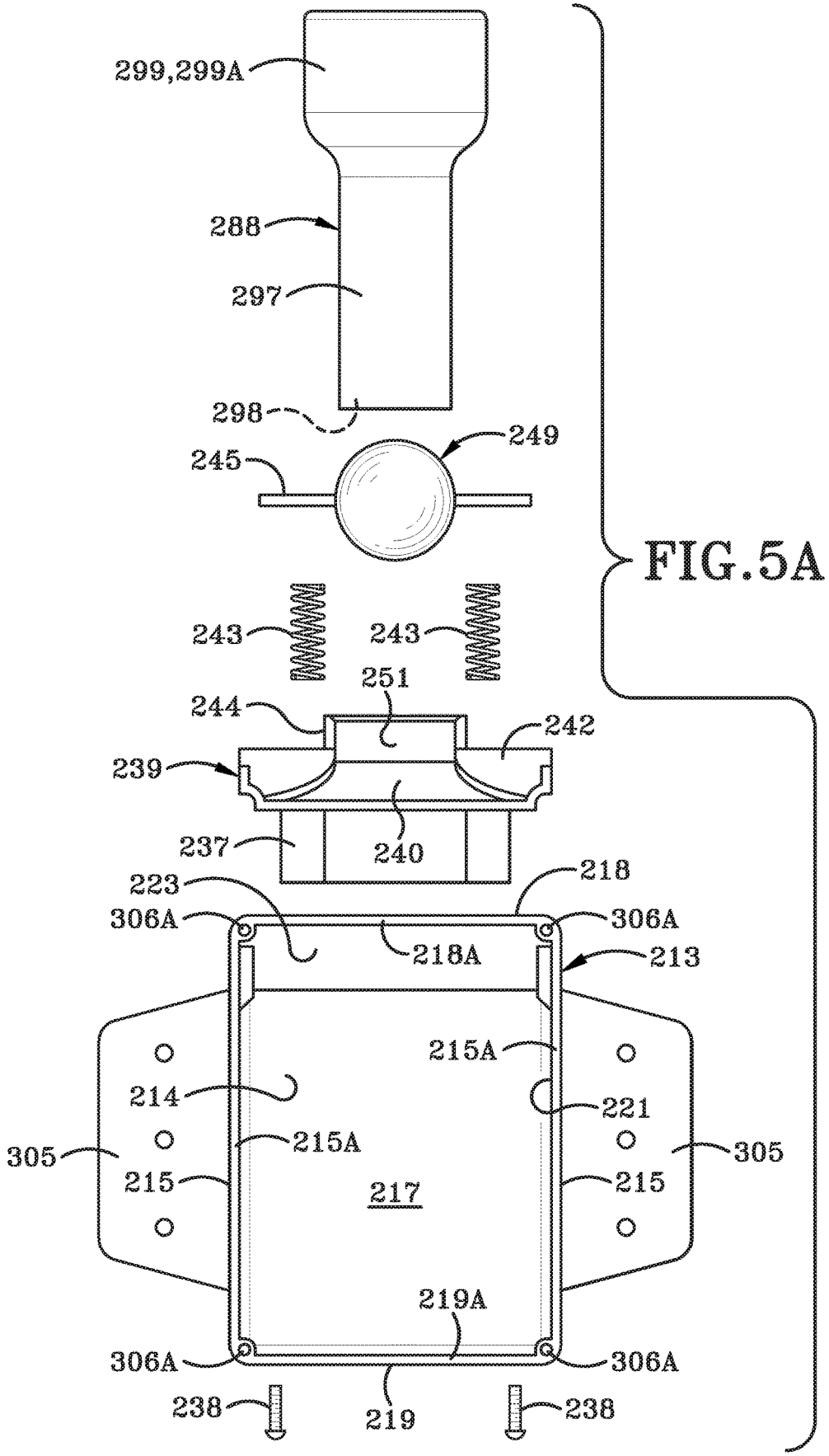
FIG. 5A is an exploded front elevation view of many of the components in the lower portion of the valve box as shown in FIG. 4A.
Figure 5B:
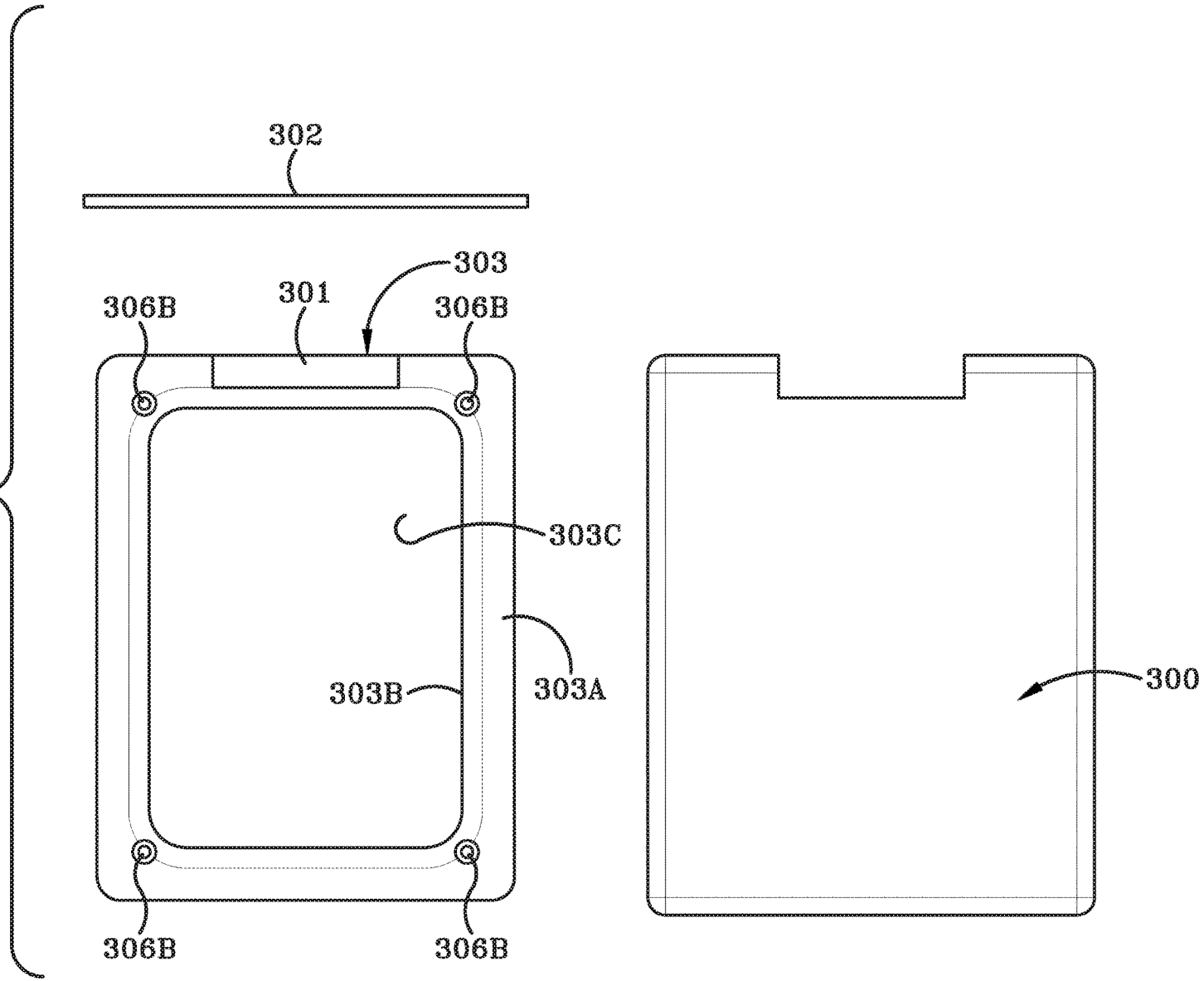
FIG. 5B is a front elevation view of the closure door and door mounting flange of the valve box as shown in FIG. 4A.
Figure 5C:
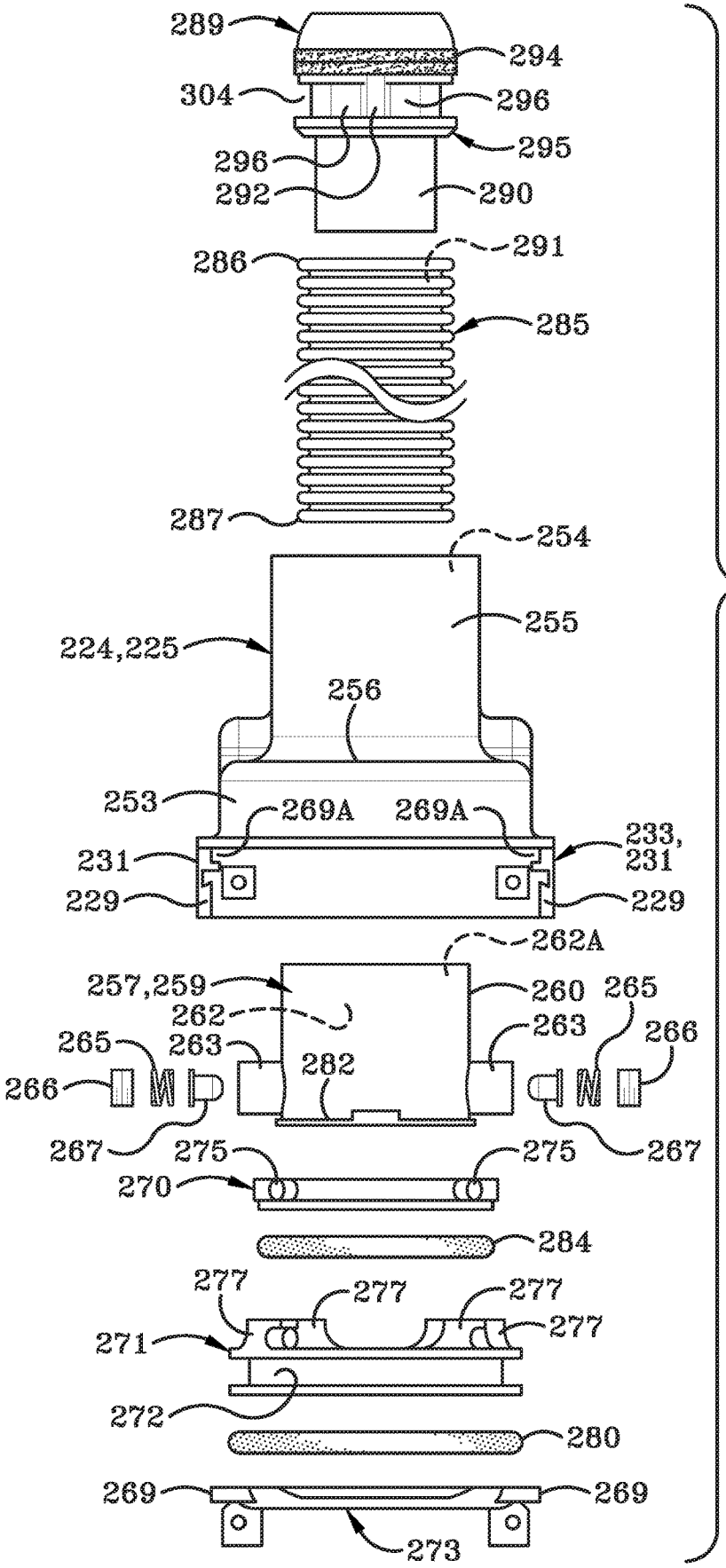
FIG. 5C is an exploded elevation view of the upper components of the valve box and distal end of the vacuum hose as shown in FIG. 4B.

Sleeve 257 is retained within interior 258 of box top 225 by a slip-fit engagement and by a two-piece hose stop ring indicated generally at 270 (FIGS. 4B and 5C). Ring 270 is clamped against the bottom of annular wall 259 of sleeve 257 by an annular O-ring support ring, indicated generally at 271 (FIG. 5C). Ring 271 is seated upon and secured within box top 225 by a one-piece horseshoe-shaped retaining bracket 273. Bracket 273 is secured within the bottom of box top 225 by a pair of lugs 269 which are slidably received in a pair of channels 269A formed in lower rectangular portion 233 of box top 225 and then by a pair of screws 274 or other type fasteners. Retaining bracket 273 can be easily removed from valve box 200 together with support ring 271 and split ring 270 for ease of repair should the need arise in the future.

Ring 270 includes four outwardly projecting studs 275 which are slidably received in four channel forming lugs 277 projecting upwardly from O-ring support ring 271 which assembles stop ring 270 and support ring 271 within the box top 225. Ring 270 has a cylindrical inner channel 281 in which is seated the bottom circular edge 282 of sleeve 257. Top opening 254 of box top 225 slidably receives an end of a rigid conduit 9 therein and is secured usually by some type of an adhesive. The two semicircular pieces which form ring 270 are joined by a pair of pins 275A (FIGS. 4B and 9).

It is readily understood that ring 270 can be a single piece and not a split ring as described above and which provides some resistance to the hose being pulled out of valve box 200 but not prevent it from being removed therefrom. This will enable the hose to be replaced, if necessary, without removing the valve box from the wall.

O-ring support ring 271 has an outer u-shaped channel 272 in which is secured an outer O-ring 280 and an inner annular ledge 283 on which is supported an inner O-ring 284. Inner and outer O-rings 280 and 284 of support ring 271 form an upper sealing assembly 310 for engaging a debris pickup nozzle handle indicated generally at 288, as shown in FIG. 6A, the function of which is described further below.

A length of a usual type of a flexible vacuum cleaning hose 285 is slidably mounted within the interior of conduit 9 and has a distal end 286 and a nozzle end 287 on which is mounted a nozzle handle 288. Referring to FIGS. 4B, 5C and 6A, a hose plug indicated generally at 289 is mounted in distal end 286 of hose 285 by inserting a cylindrical tubular end section 290 into the interior bore 291 of hose 285 and secured therein by an adhesive, friction fit, threaded connection or other type of securement means. The top end of hose plug 289 is curved downwardly and forms a bottom annular horizontally extending ledge 293 against which is seated a sealing ring 294. Sealing ring 294 is formed of a flexible material, preferably a felt-type material, and has an annular configuration with an outer diameter just slightly smaller than the inside diameter of conduit 9. An annular button release ring indicated generally at 295 is secured to and extends about cylindrical tubular end section 290 of plug 289 and clamps sealing ring 294 in position against ledge 293. Ring 295 preferably is secured on end section 290 by an adhesive or other type of attachment. Ring 295 is formed with an annular channel 304 having a pair of camming surfaces 296 which are separated by a pair of diametrically opposed vertically extending grooves 292, the function of which are discussed below (FIGS. 9 and 10).

Figure 6A:
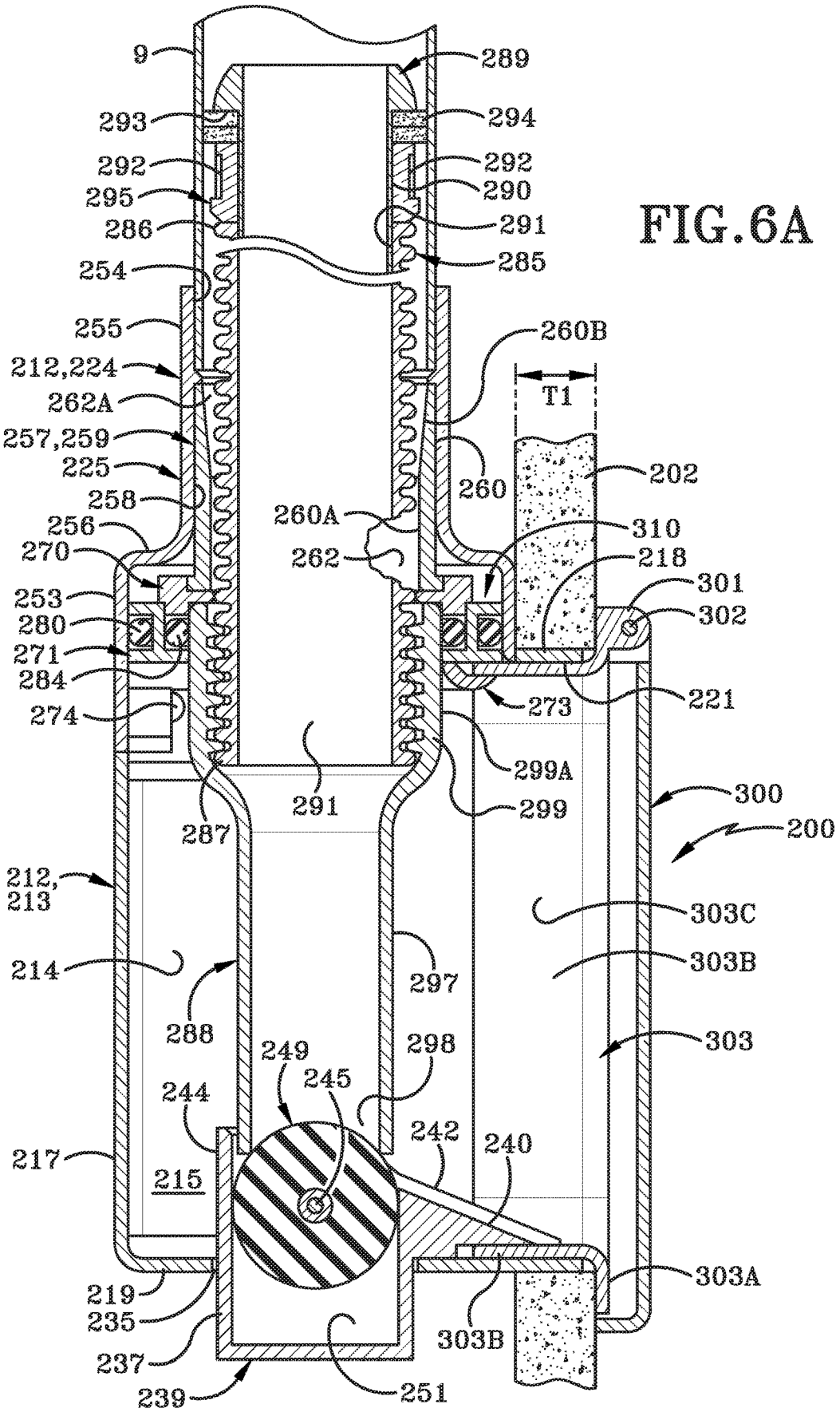
FIG. 6A is a sectional view taken on line 6A-6A in FIG. 4.

Nozzle handle 288 is of a usual construction having a cylindrical elongated end 297 which terminates in a debris pickup end opening 298 (FIGS. 4A and 6A). End 297 flares outwardly into a cylindrical hose attachment end 299 into which the nozzle end 287 of hose 285 is secured by an adhesive, threaded attachment or other type of securement means.

Hose 285 is of a usual construction used for central vacuum cleaning systems and has sufficient flexibility to move into and out of valve box 200 and around bends in the conduit when manipulated by an individual during use and which slides easily along the interior of conduit 9, but yet provides a sliding vacuum seal therebetween by sealing ring 294. Hose 285 can be the type which is non-extendable or stretchable as used in many types of vacuum cleaning systems within the concept of the present disclosure.

The other edges 215A of housing side walls 215, edge 219A of bottom wall 219, and edge 218A of top wall 218 form front end opening or port 221 through which nozzle handle 288 and hose 285 extend from for performing a debris pickup cleaning operation and then retracted into the housing for subsequent storage in the interior chamber 214 of housing 212. Preferably, an outer closure door 300 (FIG. 5B) is pivotally mounted at the upper end of lower portion 213 of housing 212 at the junction with box top 225 for opening and closing front end opening 221 in order to conceal interior chamber 214 of lower portion 213 and to provide an attractive faceplate for valve box 200 when mounted on wall stud 201 or other support structure. Door 300 is pivotably mounted with respect to housing 212 by a pivot pin 302 which extends through a flange 301 formed on and extending outwardly from a door mounting frame indicated generally at 303. Door mounting frame 303 has a rectangular outer frame 303A and a rectangular inner frame 303B which defines a rectangular opening 303C. Inner frame 303B extends perpendicularly from outer flange 303A.

Figure 6B:
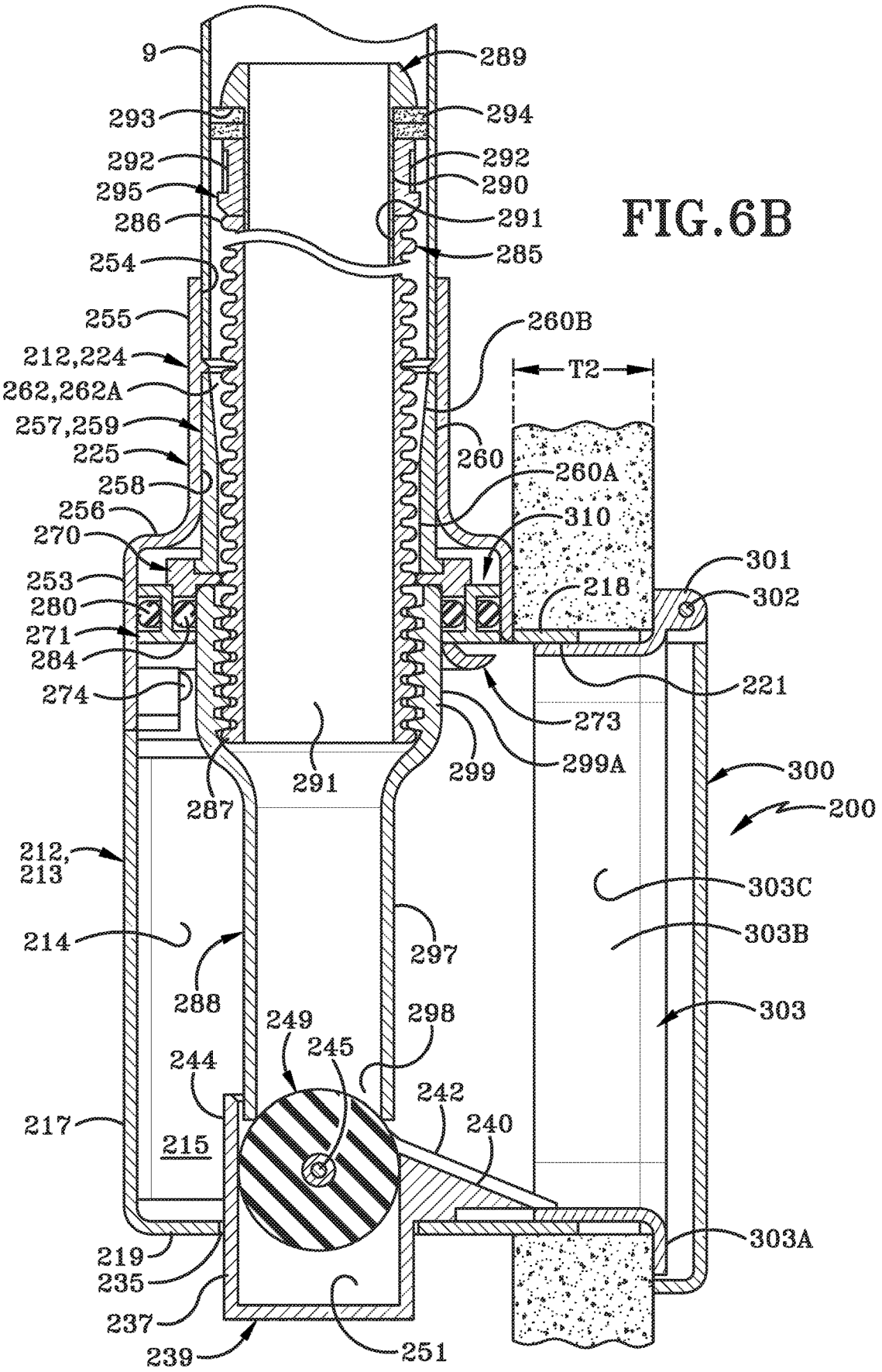
FIG. 6B is a sectional view similar to FIG. 6A showing the valve box mounted in a structure having a thicker outer wall than that shown in FIG. 6A.
Figure 7:
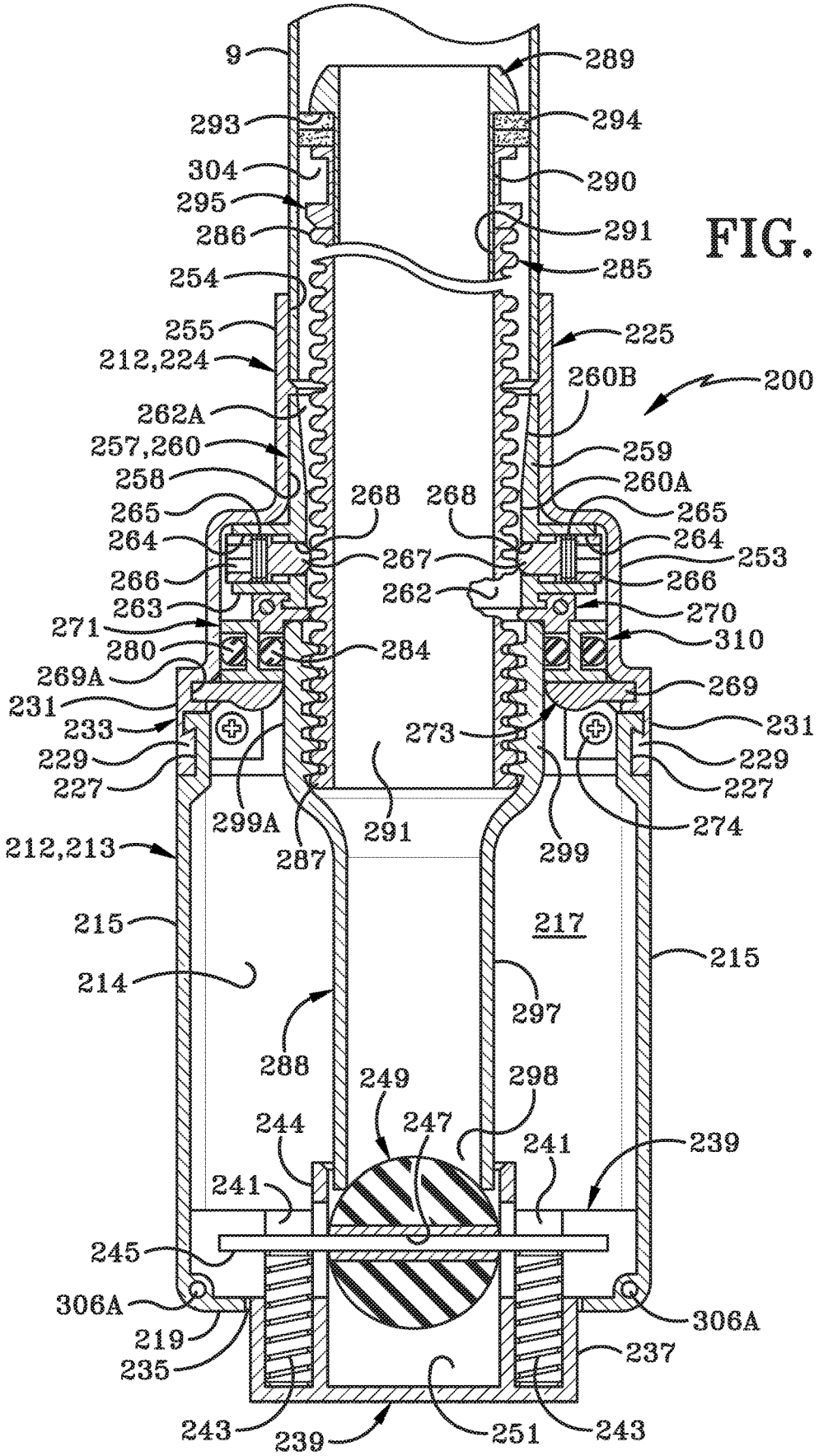
FIG. 7 is a vertical sectional front view of the valve box similar to FIG. 6A.

Door frame 303 is adjustably mounted on lower portion 213 of housing 212 by inner frame 303B forming a sliding friction fit with the interior surfaces of side walls 215, bottom wall 219, and top wall 218 as shown in FIGS. 6A and 6B to compensate for different thicknesses T1 and T2 of wall boards 206. The bottom member of inner frame 303B is slidably received beneath ramp 240 of bottom bracket 239 to assist in retaining door frame 303 on lower portion 213 of housing 212. Door frame 303 is secured to housing 212 by a plurality of fasteners 306 which extend into preformed holes 306A formed in the corners of lower portion 213, as shown in FIGS. 4 and 4A.

One or more mounting flanges 305 are formed integrally with or attached to one or both side walls 215 of lower portion 213 and extend outwardly therefrom for mounting valve box 200 to wall stud 204 or other support structure, which could be the aluminum or wood studs of a building, a concrete wall, or other type of material from which the structure is formed. Door 300, door frame 303, mounting flanges 305, and valve box 200 can be formed of various materials such as of a rigid molded plastic or various other types of metal materials without affecting the concept of the invention.

In accordance with one of the features of the invention, lower portion 213 of housing 212 and box top 225 and their relationship to each other and to door 300 do not require or form an air-tight structure since such a condition is not required due to the unique double seal arrangement described further below.

The manner of use of valve box 200 within the vacuum system shown in FIG. 2 and the interrelation and function of the various components discussed above are now described in detail. As previously stated, one of the main advantages of valve box 200 is that it is not a sealed box as in prior art inlet valves used in central vacuum cleaning systems. This feature is achieved by providing upper and lower seals in housing 212 by the use of lower bottom bracket 239 containing sealing ball 249 and upper sealing assembly 310 containing O-rings 280 and 284 with additional sealing assistance by sealing ring 294 on the distal end of hose 285 and the inner surface of sleeve 257 as shown in FIGS. 6A and 8.

When nozzle handle 288 is in a retracted stored position (FIGS. 3, 6A and 7), ball 249 is biased upwardly by coil springs 243 into sealing engagement with end opening 298 of the nozzle handle. This seals the vacuum created within hose 285 by vacuum source 5 from the surrounding atmosphere. Also, when nozzle handle 288 is in this retracted stored position, upper sealing assembly 310 and, in particular, inner and outer O-rings 280 and 284 will seal the vacuum created within conduit 9 from the ambient atmosphere and interior of housing 212. Thus, both the vacuum created within the hose and that created within the connecting conduit is completely sealed within housing 212. This avoids the necessity of providing an air-tight box as required by other inlet valves for central vacuum cleaning systems.

Figure 8:
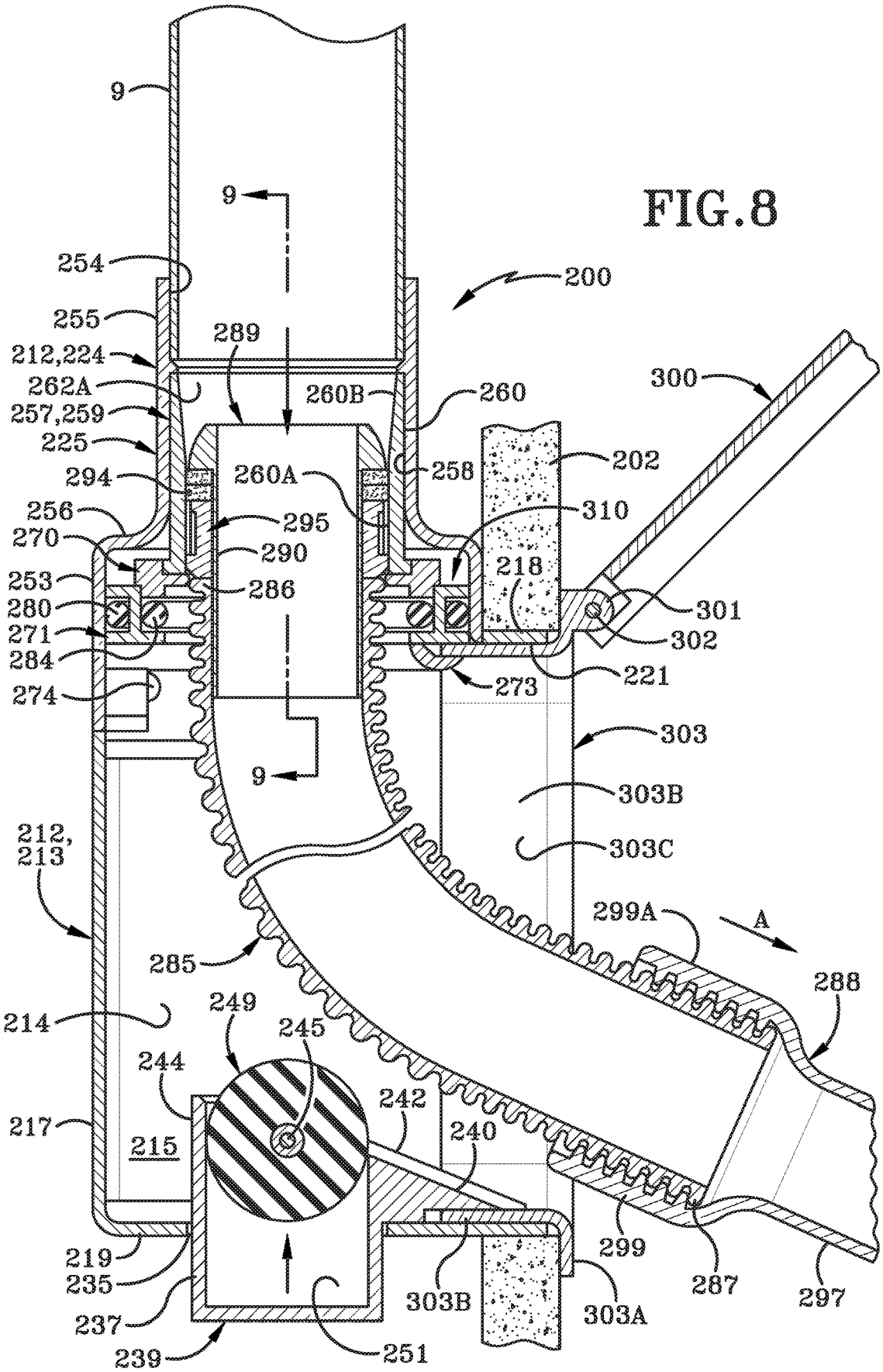
FIG. 8 is a side sectional view similar to FIG. 6B showing the nozzle handle removed from the valve box and the hose in a fully extended position.

When an individual desires to perform a cleaning operation, the individual merely grasps nozzle handle 288 and pulls outwardly, as shown by arrow A in FIG. 8, which will automatically cause ball 249 to be depressed downwardly within central channel 251. Continuing pulling outwardly on nozzle handle 288 will slide the hose along the interior of conduit 9 until a desired length is pulled from valve box 211 for use in a debris pickup cleaning operation. Hose plug 289 and, in particular, sealing ring 294 will provide a sliding seal within the interior of conduit 9 throughout its length of travel therein. This provides a sufficient seal so that most of the vacuum within conduit 9 is applied to end opening 298 of nozzle handle 288. After a cleaning operation has been completed, the user merely pushes the nozzle handle and hose back into valve box 200 through front end opening 221 in an opposite direction to that of arrow A in FIG. 8 until the end of the nozzle handle engages ramp 240 of bottom bracket 239 and upon continuing moving inwardly will easily depress ball 249 against springs 243 until the nozzle handle is fully seated in the housing after which the springs will bias ball 243 into sealing engagement with end opening 298 of nozzle handle 288 as shown in FIG. 6A. Nearly simultaneously with ball 249 sealing end opening 298, O-ring 284 will provide an air-tight seal with cylindrical outer surface 299A of hose attachment end 299. This operation is performed relatively easy by a user merely pushing the nozzle handle inwardly, resulting in the hose sliding further into conduit 9. The vacuum created within the conduit also assists in pulling the hose into conduit 9. To remove nozzle 288 from housing 212, a user merely grasps cylindrical end 297 of the nozzle handle and pulls outwardly, automatically depressing ball 249 and enabling the hose to be easily pulled from housing 212.

Another advantage of the present disclosure is that hose stop ring 270, in combination with buttons 267, prevent the distal end of the hose from being pulled completely from valve box 200. As shown in FIGS. 8-10, upon distal end 286 of hose 285 reaching valve box 200, buttons 267 by the biasing force of springs 265 will snap into engagement within annular channel 304 of ring 295 and into engagement with camming surfaces 296 which prevents further movement of the hose in an outwardly direction from housing 212. After the cleaning operation has been performed, the individual merely will grasp the portion of hose 285 adjacent front end opening 221 of housing 212 and upon a slight rotation thereof will move camming surfaces 296 along the ends of buttons 267 until the buttons reach vertically extending grooves 292 (see FIGS. 8 and 10) whereupon a slight inward pressure on the hose, coupled with the vacuum applied to conduit 9, will enable the hose to slide easily inwardly into the conduit until nozzle handle 288 reaches housing 212. Again, upon reaching this position, the nozzle handle will move easily along ramp 240 and over ball 249 until the ball snaps into sealing engagement with the open end of nozzle 288. Thus, a user will merely rotate the hose and push slightly inwardly which will automatically disengage the buttons from end plug 266, enabling the hose to be withdrawn easily into the conduit. The movement of nozzle handle 288 into the interior of housing 212 will automatically engage inner O-ring 284 of sealing assembly 310 with the external surface of nozzle 288. Thus, again upon replacing nozzle end 288 into housing 212, the vacuum within the hose and nozzle is sealed by ball 249 and the vacuum within conduit 9 is sealed by sealing assembly 310.

Also as shown in FIG. 9, as distal hose end 286 reaches box top 225 upon the full extension of the hose from within the valve box, sealing ring 294 will move along tapered annular surface 260B of sleeve 257 until providing a seal against cylindrical inner wall 260A of annular wall 259 as shown in FIG. 8. This creates an effective seal enabling the full power of the vacuum to be applied to the interior of hose 285. Thus, while the hose is being pulled from within valve box 211, a seal is applied by sealing ring 294 along the inside of conduit 9 and which will be maintained throughout the movement of hose 285 through conduit 9 and into box top 225 to its full extended position as shown in FIG. 9. Sealing ring 294 will maintain a sliding seal with the interior of conduit 9 as the hose is retracted back into conduit 9 until nozzle handle 288 reaches its final retracted stored position as shown in FIGS. 6A and 6B where an effective seal is created by ball 249 and upper seal assembly 310 provided by inner O-ring 284 and outer O-ring 280. Ball 249 provides a seal for the vacuum within the hose and nozzle handles, and upper seal 310 provides an effective seal from any area on the outside surface of the hose.

Figure 11:
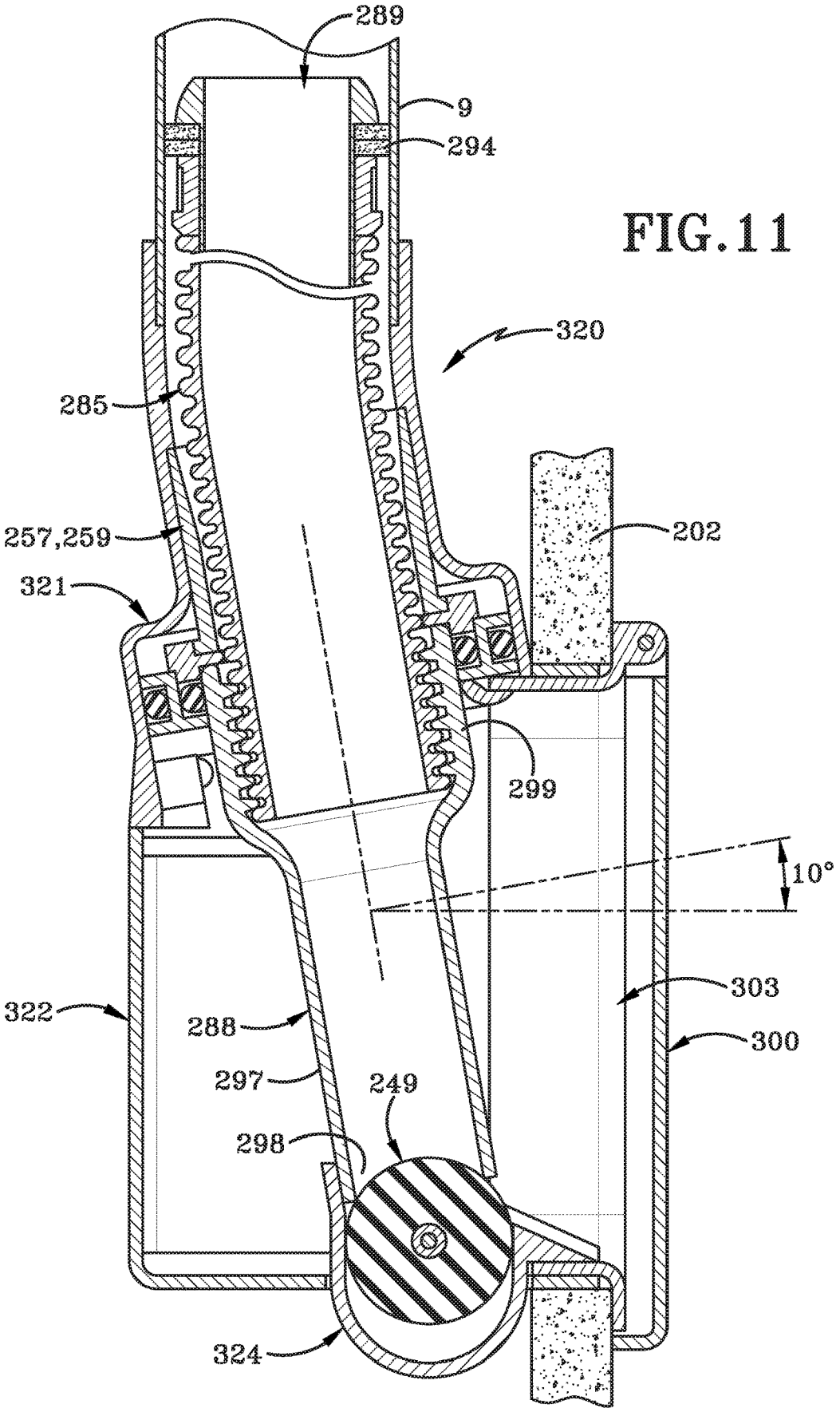
FIG. 11 is a side elevation view similar to FIG. 6A showing a modified valve box and seal assembly.
Figure 12:
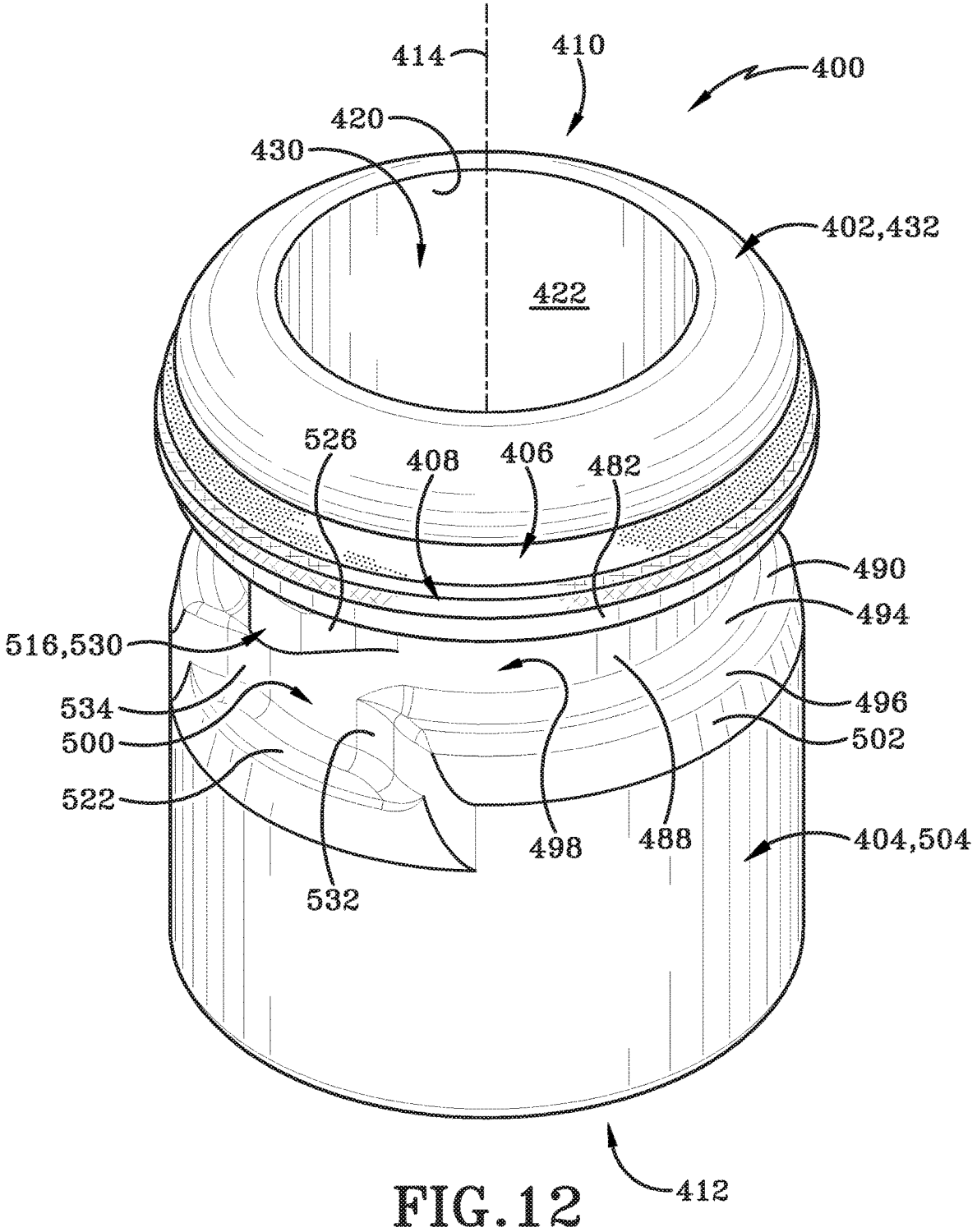
FIG. 12 is a perspective view of a hose plug in accordance with one embodiment of the present disclosure.

A modified embodiment of valve box 200 is shown in FIG. 11 and is indicated generally at 320. Valve box 320 is nearly identical to that of valve box 200 discussed above, with the main difference being that a top box 321, which is nearly identical to box top 225, is at an angle of approximately 10 degrees with respect to a lower rectangular portion 322 which is similar or nearly identical to lower portion 213 of valve box 200. This angular relationship facilitates the outward pulling movement on nozzle handle 288, making it easier to remove the nozzle handle from within the valve box and/or replacing the same therein. It also reduces the amount of force needed for nozzle handle end to depress ball 249. The other components of this embodiment are similar or the same as that described above with respect to valve box 200 and, thus, are not described in further detail.

It is readily understood that an ON/OFF switch (not shown) could be mounted in valve box 200 or closely adjacent thereto and connected by wires to vacuum source 5 for controlling the vacuum source as used in many types of prior art valves.

As depicted in FIG. 12-FIG. 19, a hose plug in accordance with one embodiment of the present disclosure is shown generally at 400. Hose plug 400 may include a first section 402, a second section 404, a first seal or O-ring 406, and a second seal or felt ring 408. Hose plug 400 includes a first end 410 opposite a second end 412, defining a longitudinal axis 414 therebetween. Some portions of the hose plug will be described relative to the longitudinal axis 414 and may be used in conjunction with the terms circumferential, or radial, relative to the longitudinal axis 414.

Figure 14:
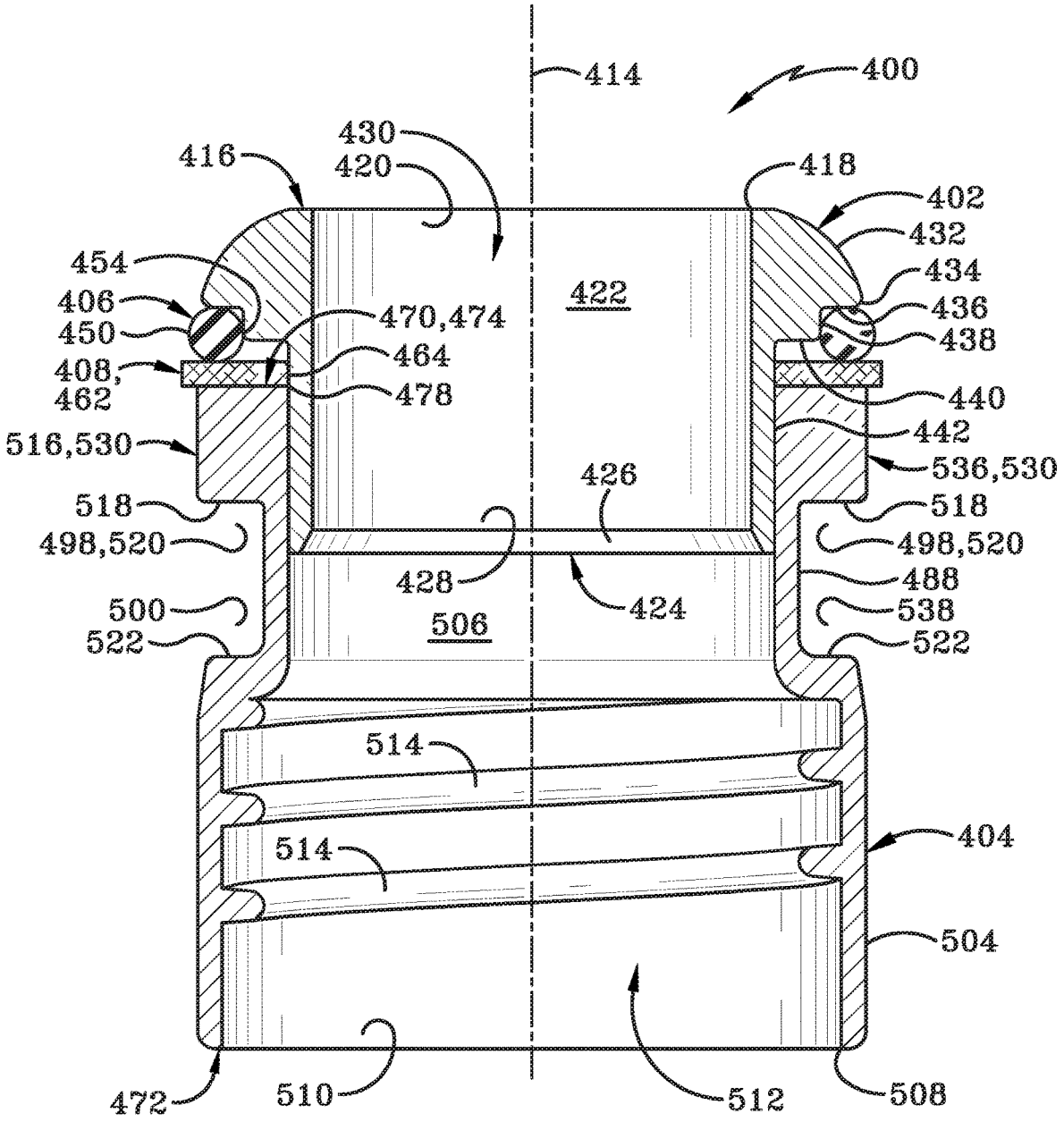
FIG. 14 is a longitudinal cross section view taken along line 14-14 in FIG. 13.
Figure 15:
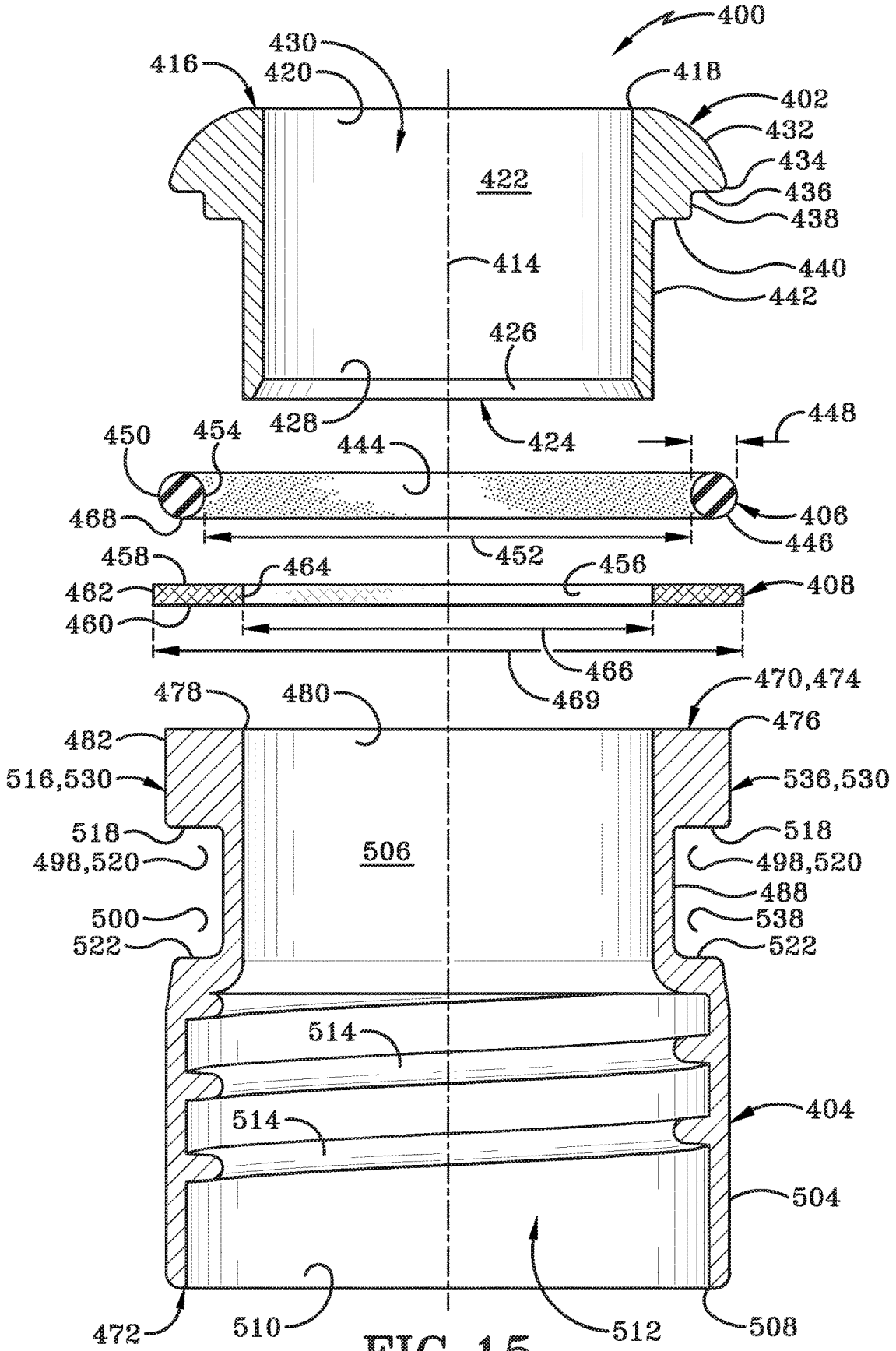
FIG. 15 is an exploded longitudinal cross section view of the hose plug of FIG. 12.

As depicted in FIG. 14 and FIG. 15, first section 402 includes a first end 416, which also defines first end 410 of the hose plug 400. First end 416 extends circumferentially around longitudinal axis 414 and defines an inner annular edge 418 defining an opening 420. A cylindrical inner surface 422 extends longitudinally from inner edge 418 to an opposing second end 424. An annular chamfered edge 426 is adjacent to the second end 424 and defines a second opening 428. Chamfered edge 426 circumscribes longitudinal axis 414 such that a first bore 430 defined by the cylindrical inner surface 422 extends between first opening 420 and second opening 428.

First section 402 further includes an annular exterior curved wall 432, which curves downwardly from the first end 416 and curves radially outward from the longitudinal axis 414. The annular curved wall 432 is convexly curved between the first end 416 and a terminal end 434, which is the radial outermost portion of the first section 402. A first ledge 436 extends radially inward from the terminal end 434 to a wall 438 that extends generally parallel to the longitudinal axis 414. A second ledge 440 extends radially inward from the wall 438. The second ledge 440 extends radially inward to a longitudinally extending exterior cylindrical wall 442. A cylindrical wall 442 extends longitudinally to the second end 424. Wall 442 may be parallel to axis 414.

The first ledge 436 is positioned closer to the first end 416 than the second edge 440. Stated otherwise, the second edge 440 is positioned closer to the second end 424 than the first ledge 436. The first ledge 436 has a radius that is larger than the second ledge 440. The first ledge 436 is an annular ledge that extends circumferentially around the longitudinal axis 414. The second ledge 440 is an annular ledge that extends circumferentially around the longitudinal axis 414. The first ledge 436 and the second ledge 440 are concentric about the longitudinal axis 414. The longitudinally aligned length of cylindrical wall 442 is greater than that of wall 438 and curved wall 432. In one particular embodiment, the length of cylindrical wall 442 may be greater than the sum of the longitudinal length of wall 438 and curved wall 432; however, other dimensional configurations are possible. Collectively, the curved wall 432, the first ledge 436, the wall 438, the second ledge 440, and the cylindrical wall 442 define an outer surface of the first section 402 that faces radially outward from the longitudinal axis 414. In one particular embodiment, first section 402 is formed from a uniform, monolithic member formed from a suitably rigid material so as to withstand deformation when the vacuum system of the present disclosure is in operation. First section 402 may be fabricated from a polymer material; however, other rigid materials are entirely contemplated such as metal. Furthermore, the integral structure of the first section 402 may be formed from multiple elements having similar configurations as one having ordinary skill in the art would understand.

First seal 406 is a generally annular or O-ring-like member defining an interior aperture 444. In one particular embodiment, first seal 406 is generally shaped like a torus such that it has a convexly curved continuous outer surface 446. First seal 406 may generally be referred to as an O-ring having elastomeric properties. The first seal 406 is circular in cross section, having an interior diameter 448. Diameter 448 has a dimension that is greater than the radially aligned length of first ledge 436. As will be described in greater detail below, the diameter 448 of the cross section of first seal 406 enables the outer tangential edge 450 of first seal 406 to extend radially outward from the terminal end 434 of curved wall 432. First seal 406 includes an inner diameter 452 measured through the longitudinal axis 414 between opposing inner tangential edges 454. The inner diameter 452 of first seal 406 is slightly greater than a diameter of the first section 402 measured through longitudinal axis 414 between opposing walls 438 between the first and second ledges 436, 440. As will be described in greater detail below, the first seal 406 is configured to snugly fit and nest with the first ledge 436 and the wall 438. Diameter 448 of a cross section of the first seal 406 is greater in dimensional length than the wall 438. Accordingly, the first seal 406 will extend below (i.e., towards the second end 412) the second ledge 440 when the first seal 406 is installed on the hose plug 400.

Second seal 408 is positioned towards the second end 412 from the first seal 406. Second seal 408 is an annular member defining an interior aperture 456 that is concentric about the longitudinal axis 414 and is concentric with the first seal 406. Unlike the first seal 406, which has a continuous convexly curved outer surface 446, the second seal 408 includes an annularly planar first surface 458 and an opposing annularly planar second surface 460. A short longitudinally-extending cylindrical side wall 462 extends between the first surface 458 and the second surface 460. An inner cylindrical side wall 464 extends between the first surface 458 and the second surface 460.

Second seal 408 includes an inner diameter 466, which is measured between opposing inner walls 464, extending through the longitudinal axis 414. The inner diameter 466 of second seal 408 is less than the inner diameter 452 of first seal 406. Inner diameter of 466 of second seal 408 is configured to be slightly larger than the outer diameter of the first section 402 measured between opposing cylindrical walls 442 through the longitudinal axis 414. Accordingly, the second seal 408 is configured to snugly fit adjacent cylindrical wall 442 on first section 402, positioned below the first seal 406. In one particular embodiment, the annularly planar and flat first surface 458 of second seal 408 is positioned and nests against a bottom tangential edge 468 on first seal 406. Second seal 408 includes an outer diameter 469 that is measured through the longitudinal axis 414 to the outer cylindrical wall 462. The outer diameter 469 of second seal 408 is slightly larger than the outer diameter of first seal 406. Accordingly, when the hose plug 400 is assembled, the second seal 408 has the greatest radial length relative to the longitudinal axis 414 on the hose plug 400. As will be described in greater detail below, the second seal 408, having the widest or greatest radial portion of the hose plug 400, enables a proper seal to be established between the hose plug 400 and the valve box assembly.

Second seal 408 may be fabricated from a type of fabric material such as felt. In one particular embodiment, second seal 408 provides a sealing arrangement that is flexible in the manner so as to prevent debris and other aggregate materials from passing by the second seal 408 when it is engaged with a portion of the box top assembly 225 or the conduit for the same. However, it is envisioned that felt-like material forming the second seal 408 does not need to be completely air-tight or hermetic because the first seal 408 establishes the hermetic seal between the hose plug 400 and an inner surface of the conduit of the box top assembly. However, it is clearly envisioned that the second seal 408 may form a hermetic seal and include the properties of precluding aggregate materials or other dust particles from passing thereby. Furthermore, while it is envisioned that the elastomeric first seal 406 be positioned closer to the first end 410 of the hose plug 400, it is entirely possible for the first and second seals to be switched such that the felt material of the second seal 408 is positioned closer to the first end 410 of the hose plug 400.

Second section 404 includes a first end 470 opposite a second end 472 aligned along the longitudinal axis 414. The first end 470 is defined by an annular surface 474 bound by an outer edge 476 and an inner edge 478 defining an opening 480. A cylindrical wall 482 extends downwardly from the first end 470 to a terminal end 484. A ledge 486 extends radially inward from the terminal end 484 to an inner cylindrical wall 488. In one particular embodiment, cylindrical wall 482 and cylindrical wall 488 are substantially parallel to the longitudinal axis 414. Additionally, the ledge 486 is substantially perpendicular to the longitudinal axis 414.

Figure 13:
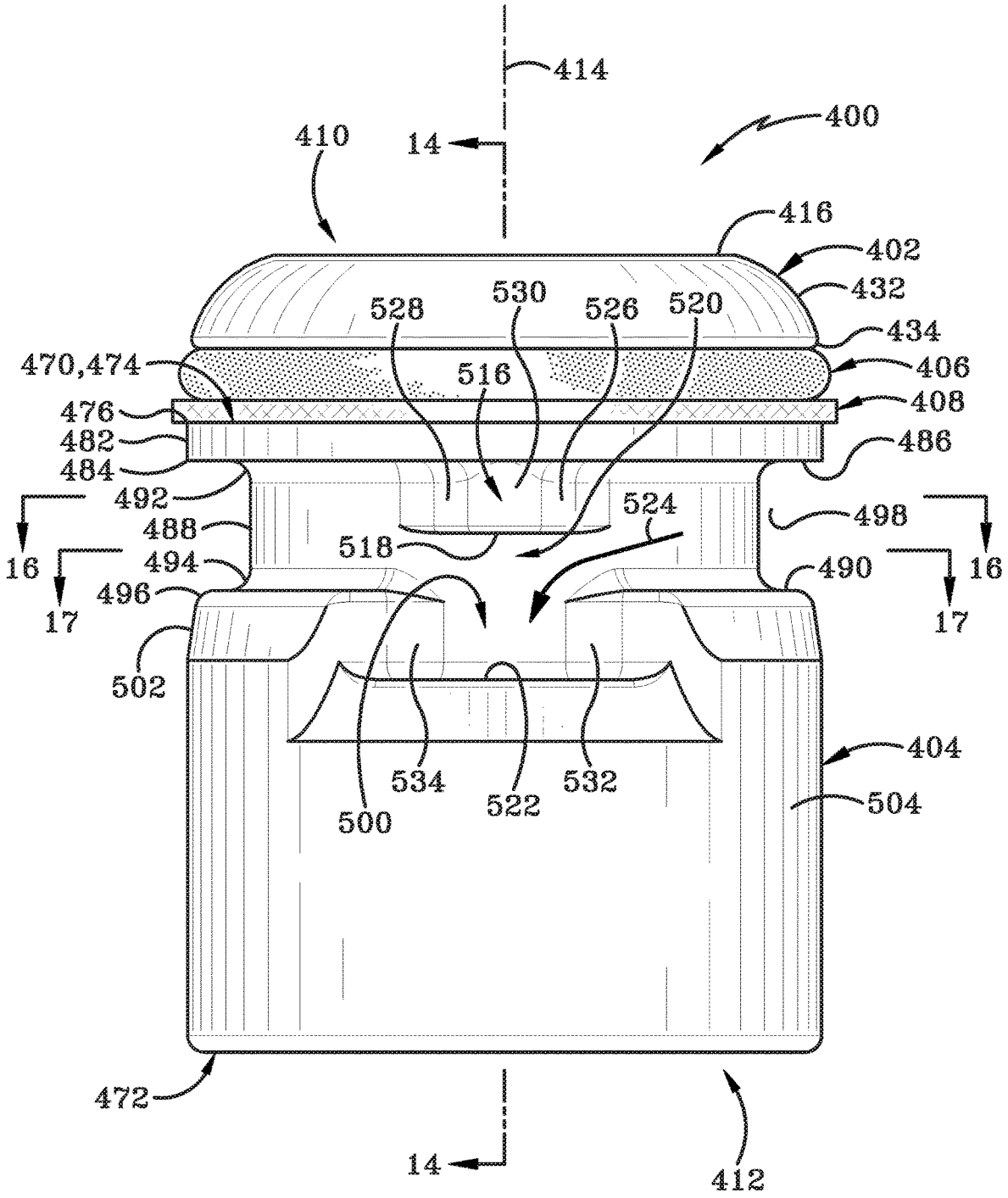
FIG. 13 is a side elevation view of the hose plug depicted in FIG. 12.

Second section 404 includes a first end 470 opposite a second end 472 aligned along the longitudinal axis 414. The first end 470 is defined by a planar annular surface 474 bound by an outer edge 476 and an inner edge 478 defining an opening 480. A cylindrical wall 482 extends downwardly from the first end 470 to a terminal end 484. A ledge 486 extends radially inward from the terminal end 484 to an inner cylindrical wall 488. In one particular embodiment, cylindrical wall 482 and cylindrical wall 488 are substantially parallel to the longitudinal axis 414. Additionally, the ledge 486 is substantially perpendicular to the longitudinal axis 414. Ledge 486 extends in a radial manner between the terminal end 484 and an inner corner 492. In one particular embodiment, the ledge 486 is a continuous annular edge having a radially aligned length between the terminal end 484 and the inner corner 492 that is in a dimensional range slightly greater than the first ledge 436. The inner cylindrical wall 488 extends longitudinally between the inner corner 492 and a second inner corner 494. The longitudinal length of the inner cylindrical wall 488, between the first and second inner corners 492, 494, is slightly longer than the dimensional length of the button 267 extending through the sleeve 257. Portions of the button 267 are configured to engage the inner wall 488 in a contacting manner. The bottom ledge 490 extends radially outward from the second corner 494 to an outer end 496. In one particular embodiment, the lower ledge 490 faces an opposite direction of the ledge 486 such that the faces of the ledges 489, 490 face each other. In one particular embodiment, the surface defined by the ledge 490 is not continuous inasmuch as a portion of the second section 404 defines a longitudinally aligned slot 500 (FIG. 13). Collectively, the ledge 486, the inner wall 488, and the second ledge 490 define an annular channel 498 configured to receive the buttons 267 therein. The annular channel 498 extends substantially around the hose plug 400 concentrically about the longitudinal axis 414.

A tapered section 502 extends longitudinally from the outer edge 496 toward the second end 472 of the second section 404. The tapered section 502 joins a cylindrical side wall 504 to extend generally longitudinal and parallel to the longitudinal axis 414 toward the second end 472. In one particular embodiment, the tapered section 502 is angled relative to the longitudinal axis 414 in a range from about one degree to about ten degrees.

Second section 408 includes an inner surface 506 extending from the first end 470 to the second end 472. An inner annular edge 508 defines a second end opening 510 such that a hollow bore 512 is in open communication with the opening 480 and the opening 510, as defined by the inner surface 506. The inner surface 506 may further include spiraling threads 514, which are sized to threadably connect with a portion of the hose 285. More particularly, the threads 514 are configured to threadably mate with the distal end 286 of the hose 285. Stated otherwise, the hose 285 is configured to be inserted into the bore 512 of second section 404 by inserting the distal end 286 of the hose 285 through the second end opening 510 and releasably and threadably attaching the second section 404 to the hose 285 via the threads 514, which mate with an exterior portion of the hose 285. However, it is to be understood that the hose plug 400 may be embodied similar to the other embodiment contained herein such that the cylindrical side wall 504 of the second section 404 is inserted into the distal end 286 of the hose 285, and secured by a frictional interference fit or another type of connection fit such as a mechanical connection, such as a screw, or a chemical connection, such as an adhesive.

As depicted in FIG. 13, a first cam 516 extends radially outward from the longitudinal axis 414. First cam 516 is positioned within annular channel 498. First cam 516 is connected with the inner cylindrical wall 488, includes a lower edge 518 that is positioned between the ledge 486 and the ledge 490. Accordingly, a portion 520 of the annular channel 498 extends continuously below the lower ledge 518 of the first cam 516 and above the ledge 490. The portion 520 of the annular channel 498 extending below the lower ledge 518 is in open communication with the slot 500 that is longitudinally aligned with the first cam 516 relative to the longitudinal axis. The slot 500 extends towards the second end 472 to a lower ledge 522. As indicated by the path of travel arrow 524, and as will be described in greater detail below, the button 267 is able to bypass the first cam 516 and slide down into the slot 500 by crossing through the portion 520 of the channel 498 that is positioned below the lower ledge 518 and above the ledge 490.

The first cam 516 includes mirroring sloped surfaces. More particularly, first cam 516 includes a first sloped surface 526 and a second sloped surface 528. In one particular embodiment, the surfaces 526, 528 are convexly curved between an apex 540 of the cam 516 and the inner cylindrical wall 488. In another particular embodiment, the surfaces for 526, 528 are concavely curved between the apex 530 and the inner cylindrical 488. The apex 530 may define a convexly curved protrusion configured to depress the button 267 retained within the housing.

Second section 404 may further include a first sloped wall 532 and a second sloped wall 534 extending adjacent the longitudinal slot 500. The sloped walls 532, 534 extend along the slot 500 and are positioned below the bottom ledge 490 when viewed from the side. In one particular embodiment, the sloped walls 532, 534 are positioned along a similar longitudinal dimension as the tapered wall 502. Stated otherwise, the tapered wall 502 is interrupted by downwardly sloping walls 532, 534 which slope radically inward towards the cylindrical wall 488 in order to define slot 500 collectively with the lower ledge 522. In one particular embodiment, the sloped walls 532, 534 may be concavely curved, may have a flat slope, or may be convexly curved. Lower ledge 522 is longitudinally aligned with the cam 516.

As depicted in FIG. 14, when viewed in cross section, the hose plug 400 may be formed from multiple components arranged together. The first seal 406 engages ledge 436 and wall 438, and extends radially beyond the terminal end 434. The lower tangential edge 468 of the first seal 406 engages the first surface 458 of the second seal 408. The second surface 460 of the second seal 408 engages the annular surface 474 defined by the first end 470 of the second section 404. The outer end 462 of the second seal 408 defines the radial outermost portion of the hose plug 400.

With continued reference to FIG. 14, the first section 402 is inserted into the second section 404. More particularly, the cylindrical side wall 442 of the first section 402 is inserted through the opening 480 into the bore 512 of the second section 404. The frictional interference fit between the first section located inside the second section 404 sandwiches and compressingly seals and press fits the first seal 406 and the second seal 408 into position. The second end 424 of the first section 402 is disposed longitudinally between the inner corner 492 and the second inner corner 494.

Figure 16:
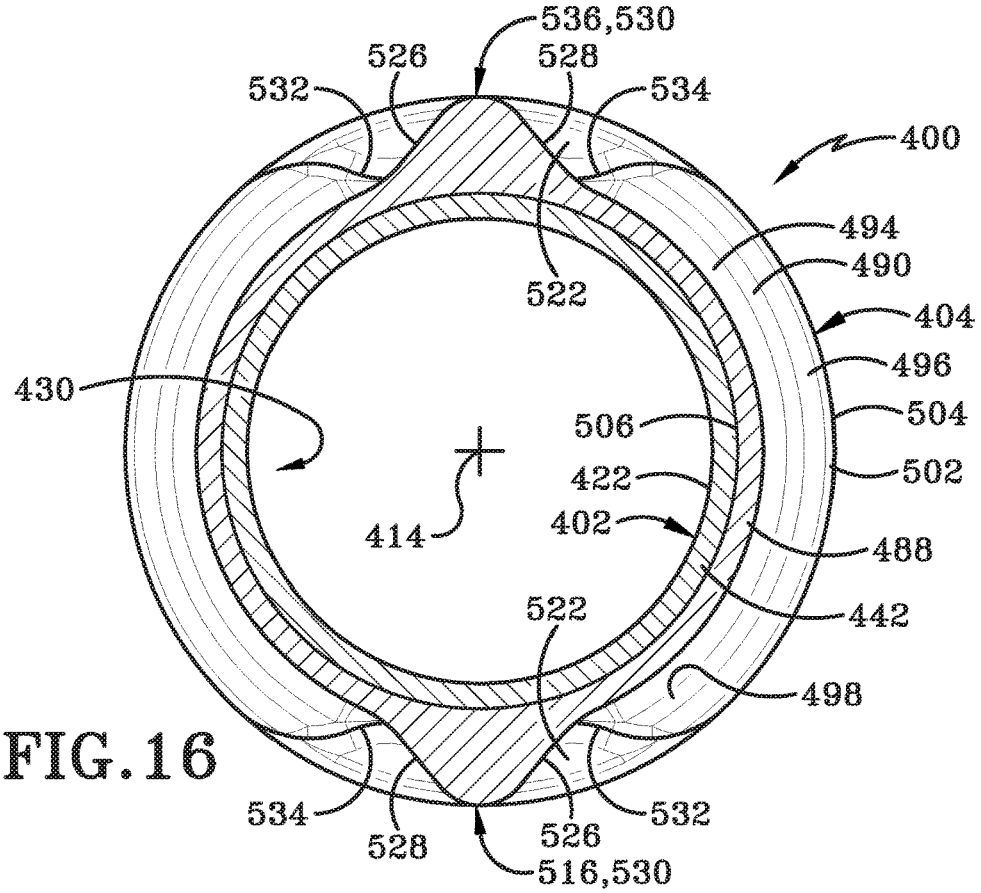
FIG. 16 is a cross section view of the hose plug taken along line 16-16 in FIG. 13.

FIG. 16 depicts a cross section of the hose plug 400 depicting that a second cam 536 may be positioned diametrically opposite the first cam 516. The second cam 536 may have a similar structure as the first cam 516 so as to include first and second sloped surfaces 526, 528 and an apex portion 530. The purpose of the second cam 536 being located diametrically opposite the first cam 516 relative to longitudinal axis 414 is to simultaneously depress the buttons 267 upon a rotational action of the hose plug 400, as indicated by arrow A in FIG. 19.

Figure 17:
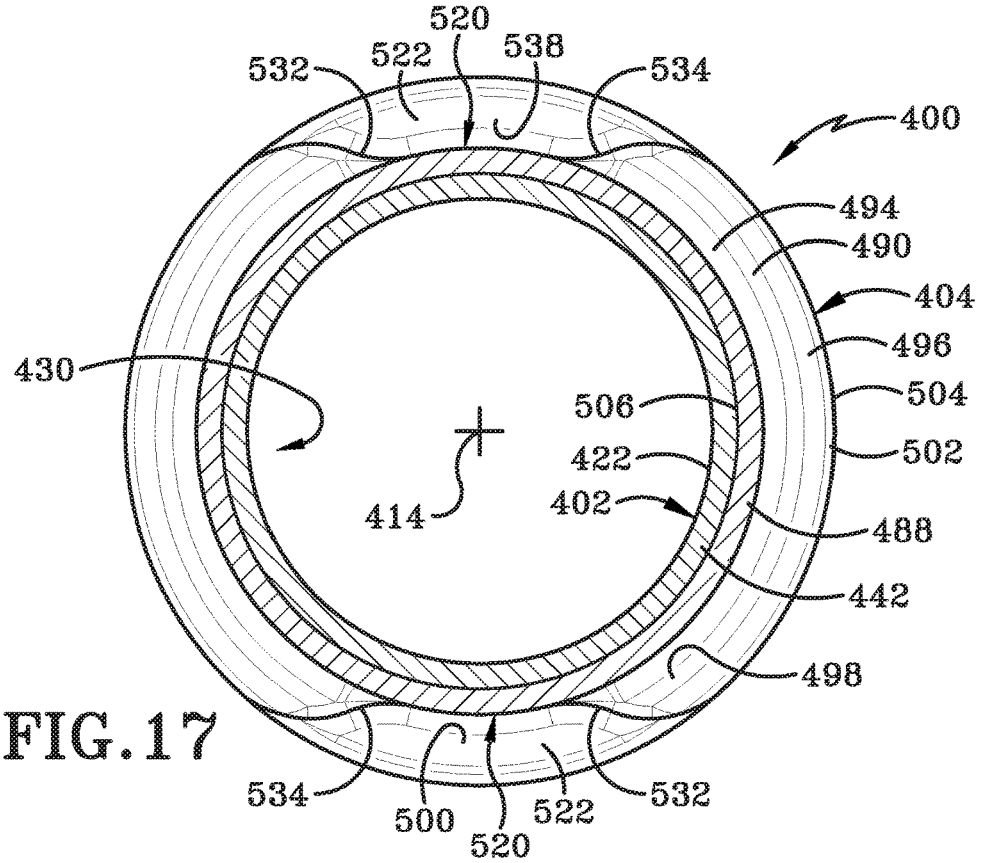
FIG. 17 is a cross section view of the hose plug taken along line 17-17 in FIG. 13.

FIG. 17 depicts that a second slot 538 may be located diametrically opposite the first slot 500 and include similar sloped walls 532 and 534. The purpose of the second slot 538 being located diametrically opposite the first slot 500 is to enable the buttons 267 to slide into the slot 538 and bypass the second cam 536 in the event the button 267 follows the path of arrow 524, as best shown in FIG. 29. Thus, the first cam is longitudinally aligned with the first slot and the second cam is longitudinally aligned with the second slot.

Figure 18:
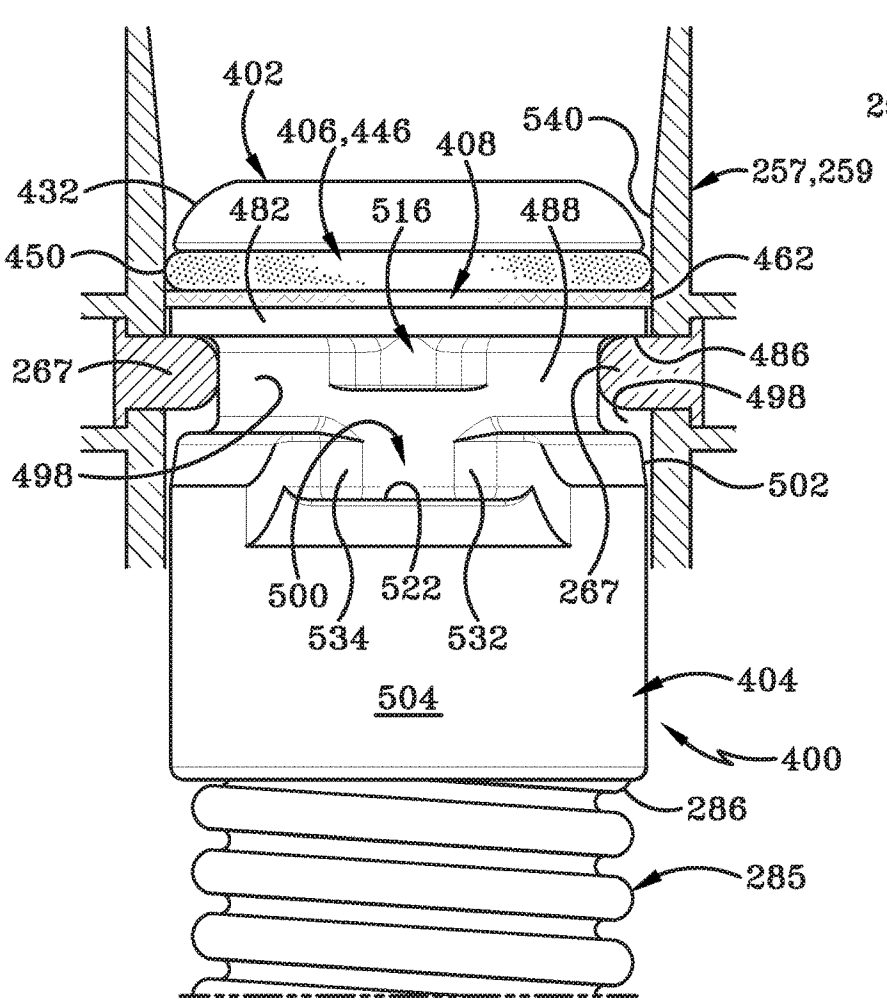
FIG. 18 is an operational environmental view of the hose plug inserted into a box top assembly with biased buttons received in an annular channel formed in the hose plug.

FIG. 18 depicts an enlarged view of the hose plug 400 inserted into the sleeve 257 with the buttons 267 disposed in the annular channel 498. In this connected position, the hose plug is secured within the sleeve 257 within the interior 258 of box top 225. The first and second seals 406, 408 engage an inner surface 540 of the sleeve 257. The double seal of the first and second seals 406, 408 ensure the hose plug 400 adequately seals the conduit such that the vacuum suction extends fully through the conduit of the hose 285, and not there around. In order to remove the hose plug 400 from the sleeve 257, an operator will rotate the hose plug 400 in the direction of arrow B. A slight downward force may be pulled on the hose 285 to establish a physical connection between the buttons 267 and the ledge 486. The buttons 267 ride along the ledge 486 and are rotated in the direction of arrow B. The cams 516, 536 will engage the respective diametrically opposite buttons 267 and depress the same in the direction of arrow 542. When the buttons are fully depressed and are substantially even with the aperture formed in the wall 259, the hose plug 400 may be longitudinally pulled outward.

Figure 19:
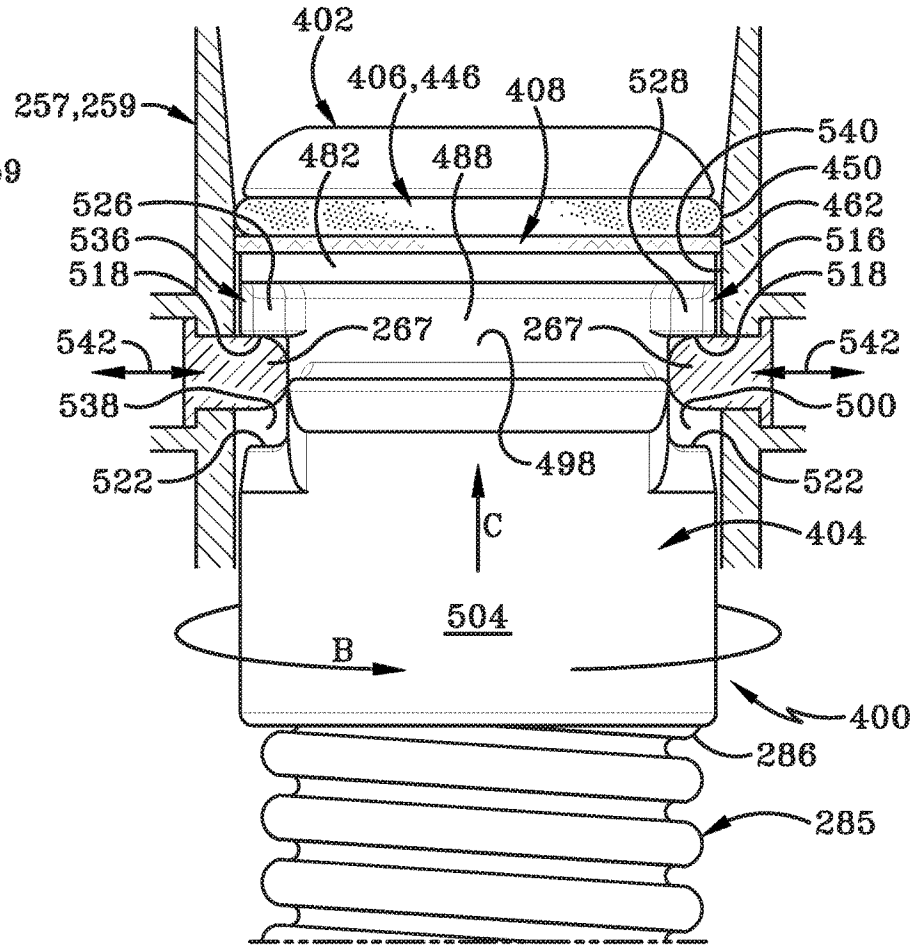
FIG. 19 is an operational environmental view of the hose plug inserted into a box top assembly with the hose plug being rotated and pushed in order to effectuate the movement of the biased buttons downwardly into a slot formed in the hose plug that is in open communication with the annular channel.

As depicted in FIG. 19, there may be instances in which the rotation in the direction of arrow B of hose plug 400 occurs, but the desired effect is not to pull the hose plug 400 from its releasable connection with the sleeve 257. In these scenarios, the hose plug 400 may be rotated in the direction of arrow B with a slight inward pressure as indicated in arrow C, such that the buttons 267 do not ride along the upper edge 486 and get depressed by the first and second cams 516, 536. Rather, the slight inward pressure in the direction of arrow C enables the buttons 267 to follow the path of arrow 524 (FIG. 13) and to slide down within the slots 500, 538. When the buttons 267 are in the slots 500, 538, a user may continue to forcibly push the hose plug 500 in the direction of arrow C, and rotate the hose plug in the direction of arrow B. This will allow the buttons to depress as they are urged inward by the sloped walls 532, 534, which are positioned on either side of the slots 500, 538. The sloped walls 532, 534 may push in the buttons 267 in the direction of arrow 542, so as to be substantially even with the wall 259, and the tapered wall 502 may continue to maintain the buttons 267 in a depressed and retracted state as the hose plug 400 is continued to be pushed inwardly in the direction of arrow C. The wall 502 effectuates the hose plug 400 being pushed into the sleeve 257 in the box top 225 so as to move the entire hose assembly from the extended position to the retracted and stored position.

FIG. 19 further depicts the method of operating a vacuum hose comprising: rotating a vacuum hose having a hose plug connected to a distal end thereof about a longitudinal axis; effecting a biased button to move through an annular channel formed in the hose plug; moving the biased button in the annular channel below a cam; and moving the biased button into a slot formed in the hose plug orthogonal to the annular channel to prevent the vacuum hose from inadvertently being disconnected by the cam affecting the biased button.

An exemplary summary embodiment of the present disclosure may provide the hose plug 400 for connection with a vacuum hose conduit comprising: the first end 410 opposite the second end 412 defining the longitudinal direction therebetween; the longitudinal axis 414 extending from the first end to the second end; the first endwall (i.e., wall 432) that is convexly curved and oriented circumferentially around the longitudinal axis; a first channel disposed towards the second end from the first endwall and oriented circumferentially around the longitudinal axis, wherein the first channel is defined by the area or space bound by the ledge 436 and wall 438; the elastomeric O-ring or first seal 406 inserted in the first channel; the second channel disposed towards the second end from the first channel and oriented circumferentially around the longitudinal axis, wherein the second channel is defined by the area or space bound by the ledge 440 and wall 442; the flexible ring, such as second seal 408, inserted in the second channel; the annular ledge 486 disposed towards the second end from the second channel and oriented circumferentially around the longitudinal axis 414; the annular channel 498, which may also be referred to as a third channel, at least partially defined by the annular ledge such that the third channel is substantially disposed towards the second end from the second channel; the first cam 516 disposed within the third channel (i.e., channel 498) adjacent the annular ledge adapted to release the button 267 in position in the box top housing, wherein the button snaps into the third channel to secure the hose plug 400 to the housing; the first slot 500 longitudinally aligned with the first cam 516 extending towards the second end in open communication with the third channel 498 adapted to receive the button therein; and the cylindrical section or wall 504 extending towards the second end from the third channel 498, wherein the cylindrical section defines the slot 500.

FIGS. 20-24 depict an auxiliary valve or secondary valve generally at 600. The secondary valve 600 is utilized as part of the central vacuum system 1 and there are typically a plurality of secondary valves 600 located throughout the structure, typically at least one secondary valve 600 in each room or near each room thereof. Secondary valve 600 is structured to cooperatively engage hose plug 400 at the end of hose 285 when the hose 285 is removed from the valve box 200 and hose plug 400 is connected to the secondary valve 600 to effectuate vacuum cleaning in one of the rooms of the structure 3.

Secondary valve 600 includes a first end 602 opposite second end 604, a first side 606 opposite second side 608. In one particular embodiment, the first end 602 is positioned vertically above the second end 604 such that the first end 602 may be considered a top end and the second end 604 may be considered a bottom end. However, it is to be entirely understood that the first end 602 and the second end 604 may be inverted such that the first end 602 is positioned vertically below the second end 604. Secondary valve 600 includes a substantially rigid frame 610, a plate 612, and a cover 614.

Frame 610 defines a central aperture 616. A cylindrical coupler 618 extends through the aperture 616 defined by frame 610. The coupler 618 includes a terminal end 620 selectively coupled with a hose 622 which is in operative communication with one of the tubes or conduits 9 connected to vacuum source 5. Coupler 618 may include an annular seat 624 positioned between terminal end 620 and a forward end 626. In one particular embodiment, the annular seat 624 is positioned rearward from an inner surface 628 of the frame 610. The forward end 626 of the coupler 618 may define a lip that has a greater outer diameter than that of the aperture 616 such that the forward end 626 rests against an outer surface 630 of the frame 610.

The plate 612 may be connected to the frame 610 by a connector 632, such as a screw. In one particular embodiment, there may be a plurality of connectors 632 extending through plate 612 into the frame 610.

Figure 20:
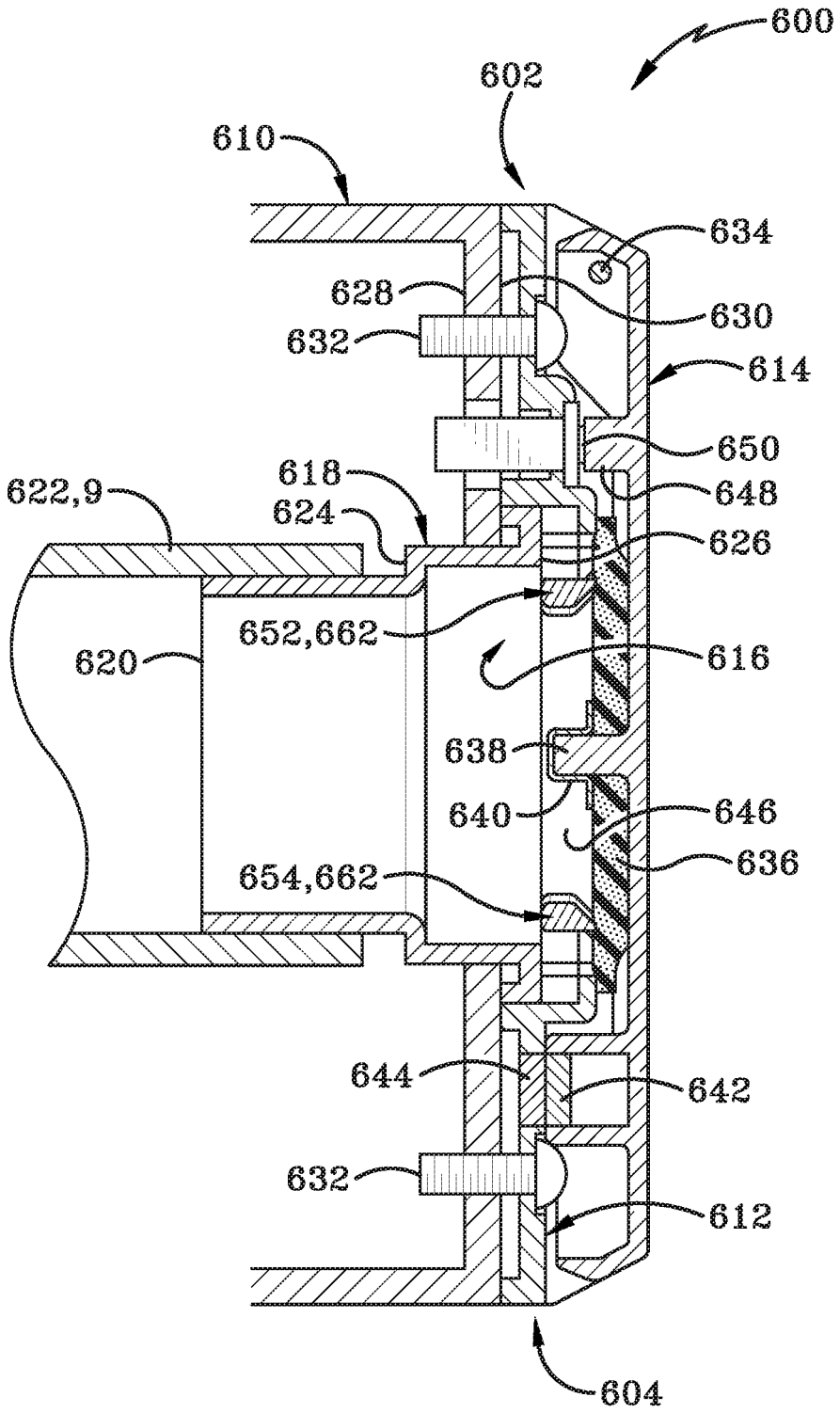
FIG. 20 is a vertical cross section view of a secondary valve in accordance with one aspect of the present disclosure.
Figure 21:
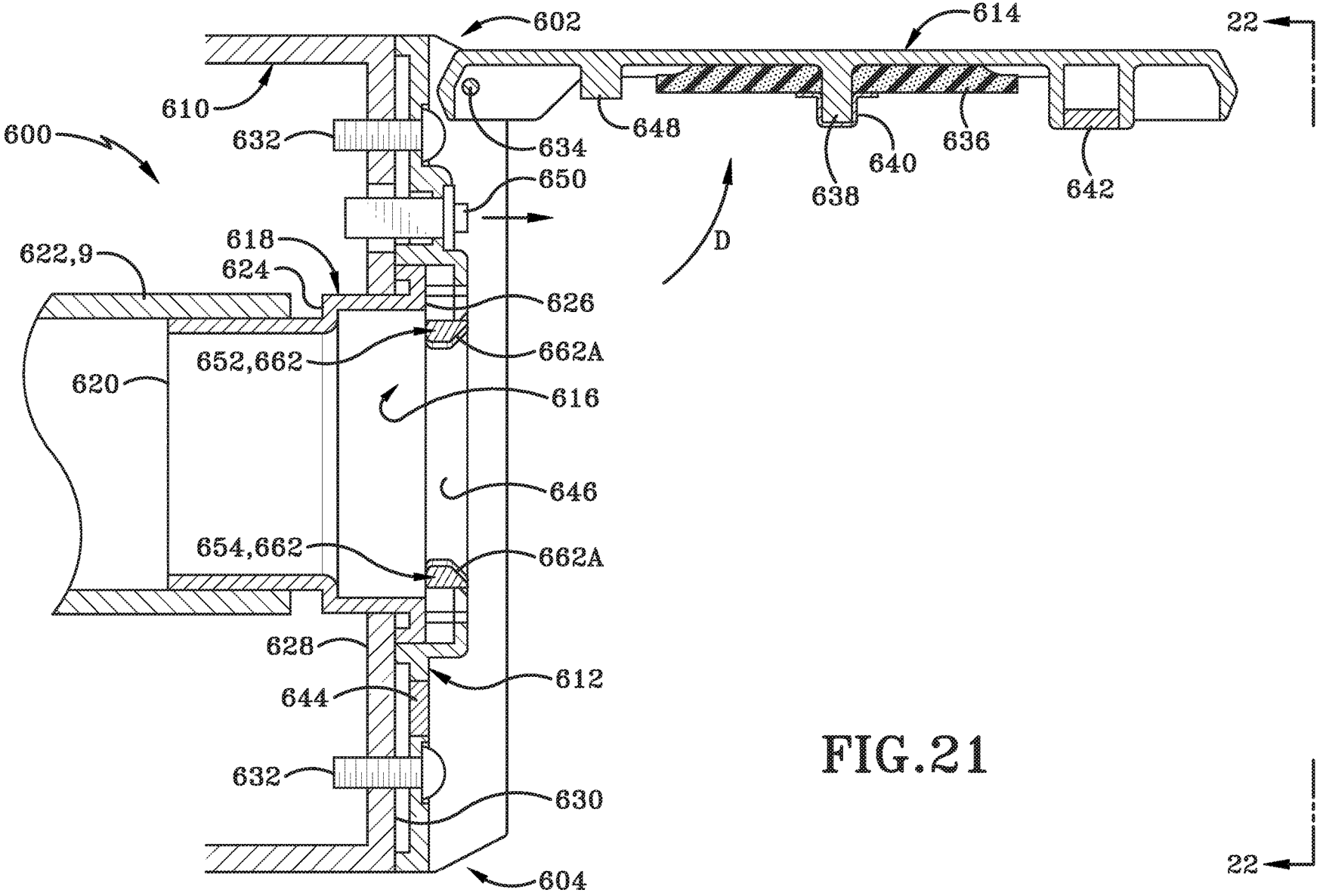
FIG. 21 is a vertical cross section view of the secondary valve with a cover moved from the closed position towards the open position.

As depicted in FIG. 21, cover 614 is pivotably connected with plate 612 via a pivot pin 634 defining an axis about which the cover 614 pivots relative to the plate 612. The cover 614 carries an annular seal 636 that extends around a protrusion 638 that is secured with a cap 640. The cover 614 further carries a metal slug 642 that is positioned to attach with a magnet 644 to maintain the cover 614 in the closed position. The magnetic force attracting the slug 642 and the magnet 644 may be overcome by a physical manipulative force of a user pivoting the cover 614 about the pivot pin 634 in the direction of arrow D. The slug 642 and the magnet 644 could change locations such that the magnet is carried by the cover 614. Thus, the cover 614 is moveable or pivotable between an open position and a closed position. When the cover 614 is in the closed position (as shown in FIG. 20), the seal 636 covers the aperture 616 or port 646 to seal the port to the vacuum 9. The seal 636 rests against the plate 612 and, more particularly, the portion of plate 612 that is in line with the aperture 616 to define the port 646. The cover 614 further includes a second protrusion 648 that operatively engages a switch 650 that may be electrically connected with the vacuum source 5 so as to operably turn on the vacuum source 5 when the cover 16 is pivoted from the closed position in the direction opposite arrow D to the open position as indicated in FIG. 21.

Figure 22:
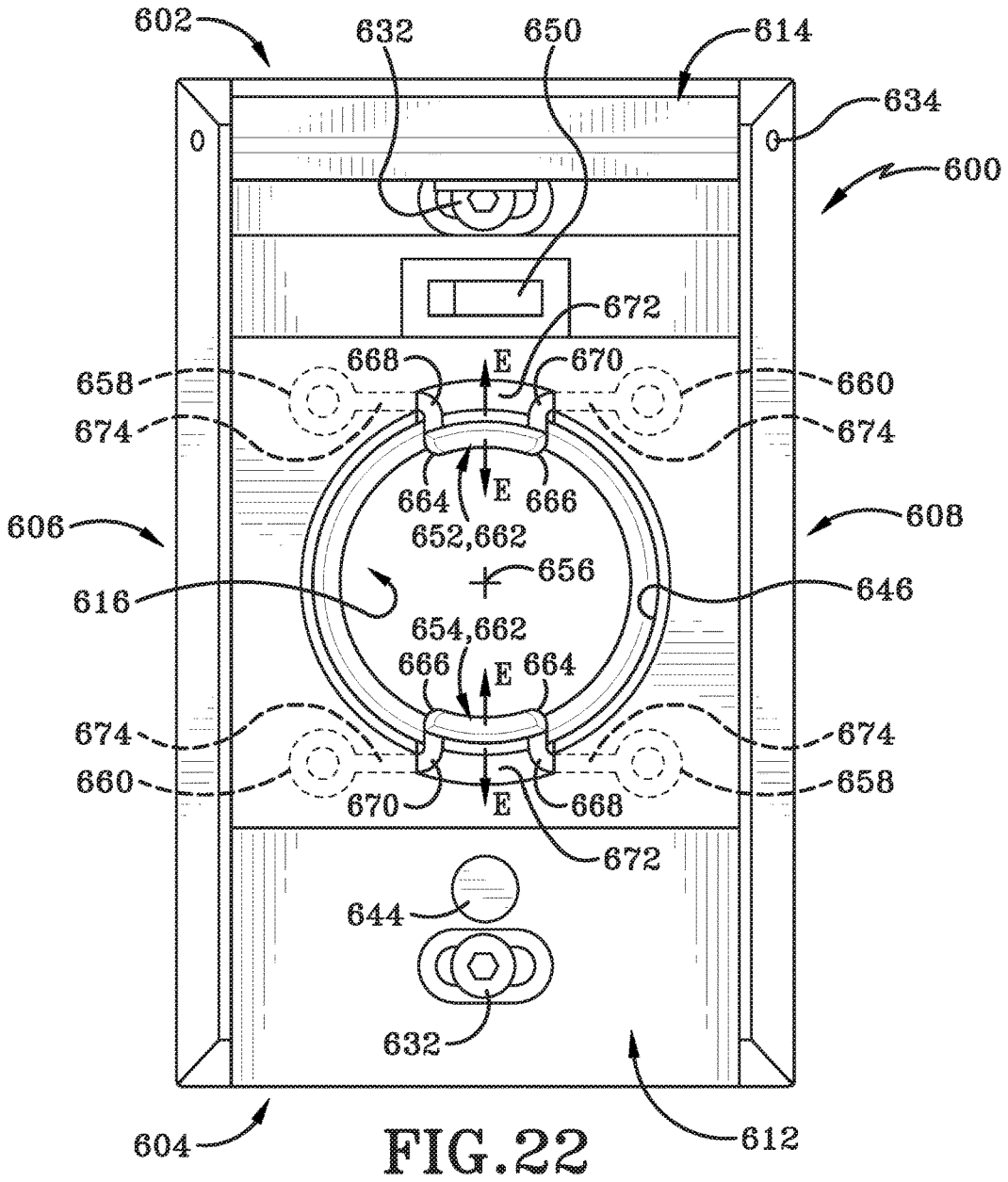
FIG. 22 is a front elevation view of the secondary valve taken along line 22-22 in FIG. 21.

As depicted in FIG. 22, the inlet valve 600 further includes a first flex member 652 connected to the plate 612. The inlet valve 600 may further include a second flex member 654 connected to the plate 612. Additionally, the first and second flex members 652, 654 may be rigidly secured, at least indirectly, to the frame 610. The first flex member and the second flex member are, at least partially, flexible, moveable relative to the central longitudinal axis 656 of the port 646. More particularly, the first and second flex members 652, 654 are radially moveable relative to the central longitudinal axis 656. As will be described in greater detail below, portions of the flex members are configured to engage with the walls 488, 492, 494 that define the channel 498 on the hose plug 400.

The first flex member and the second flex member are structurally identical and located diametrically opposite relative to the central longitudinal axis 565. Accordingly, for brevity, similar reference numerals on the flex member 652 refer to similar elements on the second flex member 654.

Figure 22A:
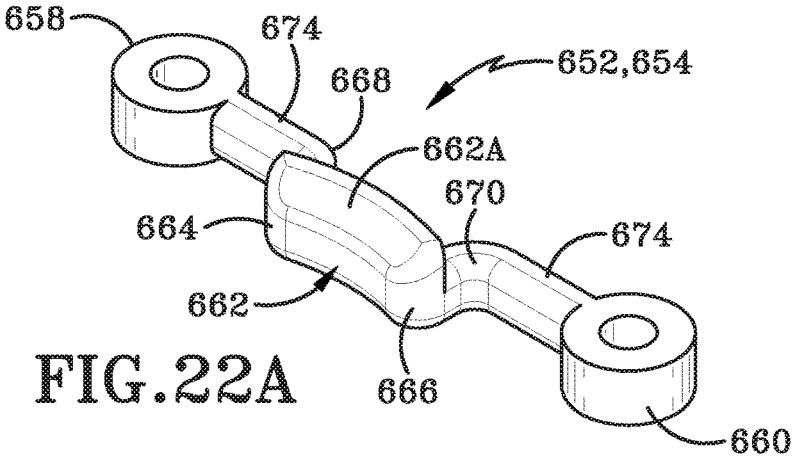
FIG. 22A is a perspective view of a flex member in accordance with one aspect of the present disclosure.

FIG. 22A depicts that each flex member includes a first end 658 opposite a second end 660. The first end 658 may define an annular shape to extend around a pin that connects the flex member to the plate 612. The second end 660 of the flex member may be similarly shaped with an annular member that is configured to receive a pin therethrough to connect the flex member with the plate 612. A central portion of the flex member is concavely curved. More particularly, the section 662 is concavely curved between a first section end 664 and a second section end 666. The concavely curved section 662 includes a corresponding concavely curved surface. The concavely curved surface on curved section 662 moves radially relative to the longitudinal axis 656. Curved section 662 may also include a curved chamfer 662A. Curved section 662 is associated with an angle of an arc relative to the central longitudinal axis 656 and is in a range from 15 degrees to 45 degrees relative to the port 646 which extends fully 360 degrees in the cross section. Each flex member further includes a flexible bend 668 located between the first end 658 and the curved section 662. Each flex member may additionally include a second curved bend 670 positioned between the second end 660 and the curved section 662. Curved bends 668, 670 enable the curved section 662 to flex inwardly and outwardly radially relative to the longitudinal axis 656 as indicated by arrow E in FIG. 22.

The curved section 662 of each flex member 652, 654 may occupy an arc length that is in a range from about five percent to about twenty percent of the total 360 degrees circumference of the port 646 aligned with the aperture 616. The arc length of the concavely curved section 662 may be optimized depending upon the size and shape of channel 498 on the hose plug 400.

The plate 612 includes partial cutouts 672 through which the curved section 662 of the flex members 652, 654 move in the direction of arrow E. Stated otherwise, a portion of the bends 668, 670 fit through the cutout section 672 established by the plate 612. In one particular embodiment, the cutout section 672 may be located at the top and the bottom of the port 646 as shown in FIG. 22. Stated otherwise, the cutout section 672 is at the 12 o'clock position and the 6 o'clock position when viewing the secondary valve 600 from the front. However, it is to be entirely understood that the relative location of the cutout sections may be at any position of the port 646. For example, it is entirely possible that the flex members 652, 654 are oriented vertically such that they flex towards the first side 606 and towards the second side 608, rather than flexing towards the first end 602 and towards the second end 604, as shown in FIG. 22.

Each flex member 652, 654 may be substantially constructed or fabricated from a unibody material that enables the flex members to be monolithic and their specific structural configurations provide the flexibility and resiliency to spring and flex in the direction of arrow E when the hose plug 400 is inserted into the port 646 in order to connect the hose plug 400 to the secondary valve 600 of the vacuum system 1.

When each flex member 652, 654 flexes in operation, the curved section 662 will move, deflect, or translate in the direction of arrow E. Thus, it is within the scope of the present disclosure and appended claims to provide a curved section, such as section 662, that moves or translates relative to the axis 656 to connect with the hose plug, regardless of how the movement is accomplished. For example, the movement or translation of the curved section 662 may be accomplished by springs, motors, hydraulics, gravity, pivoting action, rotary motion, oscillating motion, or other effectuated linear motion.

With primary reference to the figures in which the flex members 652, 654 effectuate the movement of the curved section 662, the bends 668, 670 flex inwardly to deflect through the cutout 672. During the flexure of the bends, the annular ends 658, 662 remain fixedly connected with the plate 612. However, due to the annular loop defined by the respective ends 658, 660, there may be a slight rotation of the looped ends about the pin that connects the plate 612 to the first and second flex members 652, 654. Stated otherwise, a short longitudinal extension 674 of flex members 652, 654 may rotate about the center of the annular loop defined at the end 658 as the curved section 662 flexes or deflects in the direction of arrow E. In this particular example, the extension portion 674 is located between the looped annular end 658 and the first bend 668. The extension 674 would be positioned intermediate the plate 612 and the frame 610. In one particular embodiment, the length of the extension 674 is approximately coplanar with a tangent plane intersecting a point on the 360 degrees circumference of the port 646. A similar extension 674 is located between the second bend 670 and the second end 660. Stated otherwise, the lengthwise arrangement of the flex members 652, 654 are aligned substantially orthogonal to the longitudinal axis 656 of the port 646.

When the flex members 652, 654 are in their neutral or resting position (FIG. 22), the curved section 662 extends partially inward into the port 646 to occupy a portion of the aperture 616. Stated otherwise, the diameter between the respective curved sections 662 on the first flex member 652 and the second flex member 654 is less than the diameter of the port 646 measured through the longitudinal axis 656. The decreased diameter between the two curved sections 662 enable the flex members 652, 654 to cooperatively engage the annular channel 498 on the hose plug 400 when the hose plug 400 is selectively connected to the secondary valve 600, as will be described in greater detail below.

Figure 23:
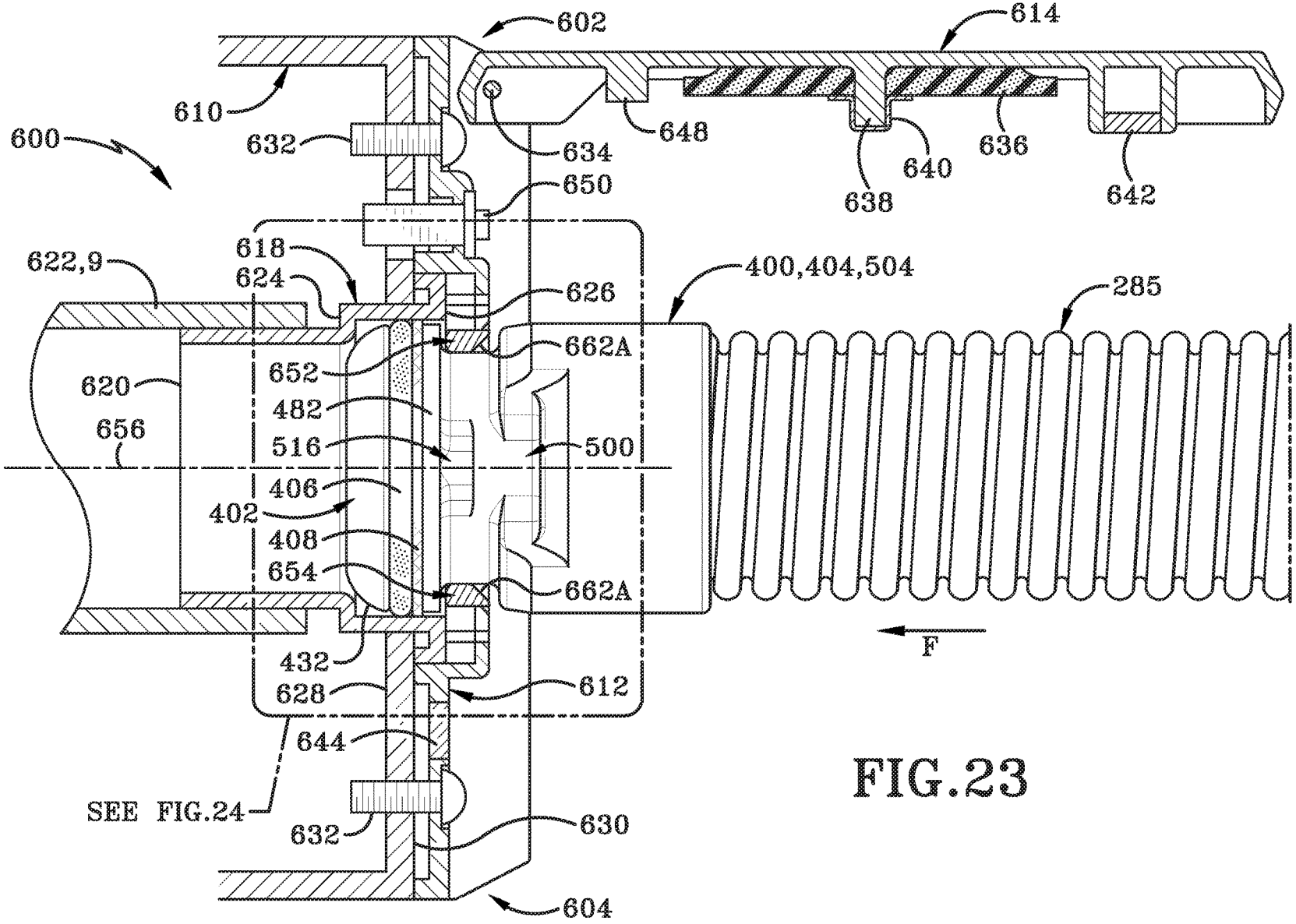
FIG. 23 is an operational vertical cross section view of the secondary valve of the present disclosure receiving the hose plug therein.
Figure 24:
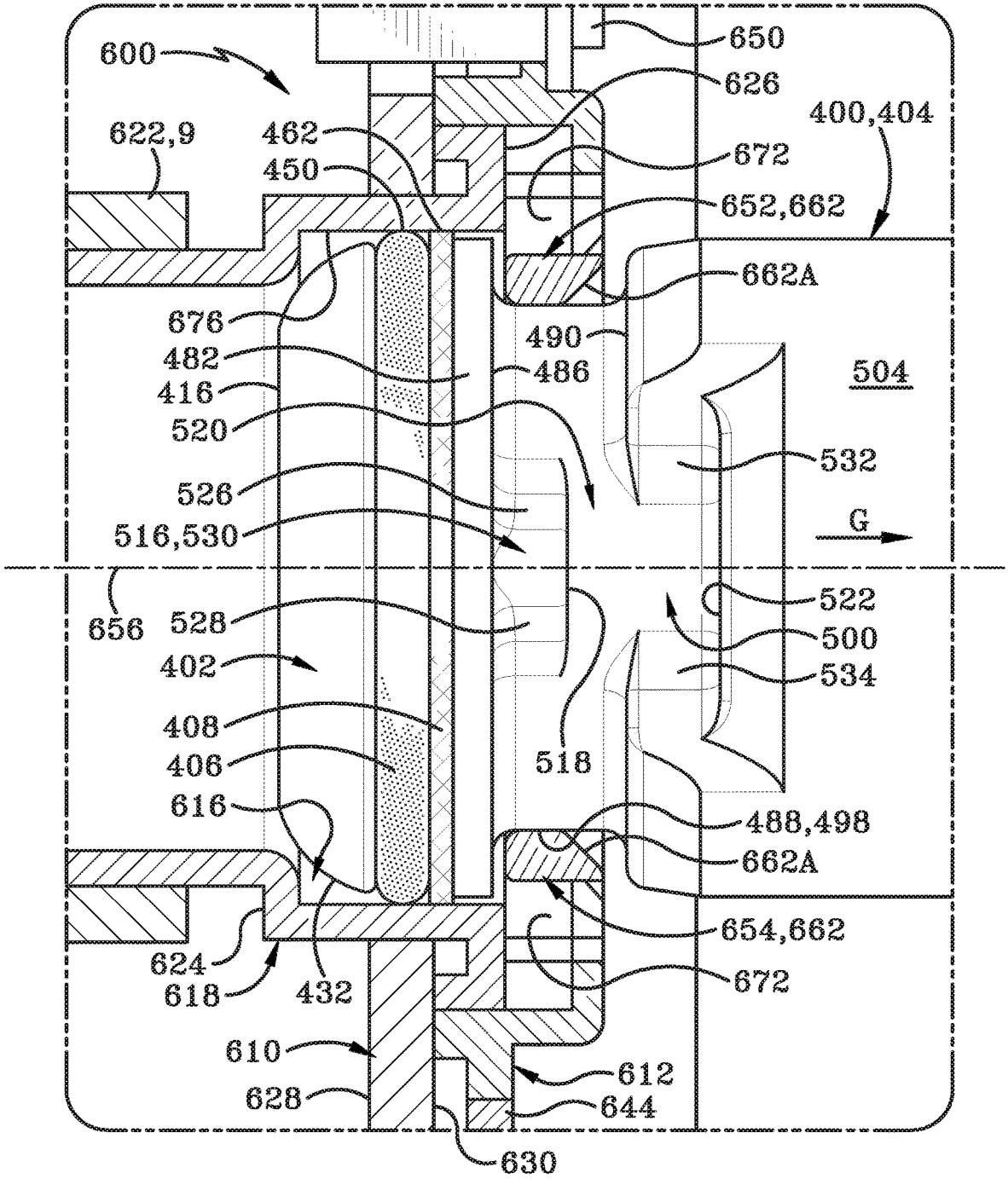
FIG. 24 is an enlarged partial cross section view of the hose plug connected with the secondary valve as indicated by the region labeled "See FIG. 24" in FIG. 23.

In operation, and as depicted in FIG. 23 and FIG. 24, the hose plug 400 is configured to connect with the secondary valve 600. When the cover 614 is in the open position such that the port 646 defining the aperture 616 is exposed, the hose plug 400 is moved in the direction of arrow G towards the port 646. The hose plug 400 can only flex the first flex member 652 when the cover 614 is moved from the closed first position. The annular curved wall 432 on the first section 404 passes by the first and second flex members 652, 654 flexibly pushing them radially outward relative to the longitudinal axis 656. The curved wall may contact the curved chamfer 662A to encourage and push the curved section in the direction of arrow E (FIG. 22). This enables the hose plug 400 to be inserted into the coupler 618 such that the first seal 406 and the second seal 408 engage an inner surface 676 of the coupler 618 and the curved wall 432 rests adjacent the annular seat 624. A generally hermetic seal is formed between the inner surface 676 and the seals 406, 408. This creates an open vacuum channel through the hose plug 400 with the tubes 9.

As depicted in FIG. 24, when the hose plug 400 is connected with the secondary valve 600, the first flex member 652 occupies the annular channel 498 and is disposed closely adjacent the walls 486, 488, 490. Similarly, the second flex member 654 is disposed in the annular channel 498 diametrically opposite the first flex member 652. The second flex member 654 is closely adjacent the walls 486, 488, 490. The vacuum may be automatically turned on from the activation of switch 650 by protrusion 648. When the hose plug 400 is connected to the secondary valve, an operator may vacuum a portion of the home or structure.

When it is time to release the hose plug 400 from the secondary valve 600, the hose plug 400 is rotated about the longitudinal axis 656 so as to engage the apex portion 530 of the first cam 516 or the second cam 536 with the respective flex member 652 or 654. The cams 516, 536 engage the curved section 662 or the curved chamfer 662A to push them radially outward. The cams 516, 536 enable the flex member to be deflected radially outward such that the concavely curved section extends radially beyond the radial outer edge of the hose plug 400. This enables the hose plug 400 to be retracted or removed in the direction of arrow G (FIG. 24). After the hose plug 400 has been removed from the secondary valve 600, the cover 614 may be closed by pivoting the same about the pivot pin 634 from its open position to its closed position as indicated in FIG. 20. When in the closed position, the seal 636 covers the port 646 such that no air flows through this section tube 9 in order to effectively close the secondary valve 600 from this portion of the vacuum system 1.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

The invention claimed is:

1. An inlet valve for a central vacuum system comprising:

a port defined by a plate adapted to receive an end of a hose therein along an axis;

a concavely curved surface on a moveable member, wherein the concavely curved surface is radially moveable relative to the axis;

the moveable member connected to the plate; wherein the concavely curved surface is adapted to move radially away from the axis as the hose passes the moveable member; and the concavely curved surface is adapted to move radially towards the axis to fit within a channel defined adjacent the end of the hose;

wherein the moveable member is a first flex member that is, at least partially, flexibly moveable radially relative to the axis;

the first flex member is connected to the plate, wherein the first flex member is adapted to flex radially away from the axis as the hose passes the first flex member;

the first flex member is adapted to flex radially towards the axis to fit within a channel defined adjacent the end of the hose;

a cutout section defined by the plate; and a portion of the first flex member extending through the cutout section when the first flex member is flexed radially towards the axis to fit within the channel defined adjacent the end of the hose.

2. The inlet valve of claim 1, further comprising:

a first end of the first flex member connected to the plate;

a second end of the first flex member connected to the plate; and a concavely curved section of a body of the first flex member located intermediate the first end and the second end of the first flex member.

3. The inlet valve of claim 2, further comprising:

wherein the port is 360 degrees in cross section; and an angle of an arc defined by the concavely curved section that is in a range from 15 degrees to 45 degrees relative to the port.

4. The inlet valve of claim 2, further comprising:

a first flexible bend in the first flex member positioned between the concavely curved section and the first end; and a second flexible bend in the first flex member positioned between the concavely curved section and the second end.

5. The inlet valve of claim 4, further comprising:

a first annular loop at the first end of the first flex member; and a second annular loop at the second end of the first flex member.

6. The inlet valve of claim 1, further comprising:

a second flex member that is, at least partially, flexibly moveable radially relative to the axis and located diametrically opposite the first flex member relative to the axis; and a concavely curved section on each of the first and second flex members that respectively engage an annular channel defined adjacent the end of the hose.

7. The inlet valve of claim 1, wherein the first flex member comprises a linear section that is positioned along a tangent plane of the port.

8. The inlet valve of claim 1, wherein the portion of the first flex member is radially outward from the cutout section when the first flex member is flexed radially away from the axis as the hose passes the first flex member.

9. The inlet valve of claim 1, further comprising:

a twelve o'clock position of the port; and a portion of the first flex member intersecting the twelve o'clock position of the port.

10. The inlet valve of claim 1, further comprising:

a pivot action of a first end of the first flex member when the first flex member flexes radially away from the axis.

11. The inlet valve of claim 1, further comprising:

a frame connected to the plate; and wherein the moveable member is disposed between the frame and the plate and is lengthwise oriented orthogonal to the axis.

12. The inlet valve of claim 1, further comprising:

a central curved section defining the concavely curved surface, and the central curved section including a curved chamfer adapted to effectuate the movement of concavely curved surface as a cam on a hose plug passes the curved chamfer.

13. The inlet valve of claim 1, further comprising:

a cover connected to the plate moveable between a closed first position and an open second position; and wherein the hose plug can only move the concavely curved surface when the cover is moved from the closed first position.

* * * * *